US007850262B2

(12) United States Patent
Hirayama et al.

(10) Patent No.: US 7,850,262 B2
(45) Date of Patent: Dec. 14, 2010

(54) HEAD SUBSTRATE, PRINTHEAD, HEAD CARTRIDGE, AND PRINTING APPARATUS

(75) Inventors: Nobuyuki Hirayama, Fujisawa (JP); Masataka Sakurai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 195 days.

(21) Appl. No.: 11/913,708

(22) PCT Filed: May 11, 2006

(86) PCT No.: PCT/JP2006/309883

§ 371 (c)(1),
(2), (4) Date: Nov. 6, 2007

(87) PCT Pub. No.: WO2006/121204

PCT Pub. Date: Nov. 16, 2006

(65) Prior Publication Data

US 2009/0091594 A1 Apr. 9, 2009

(30) Foreign Application Priority Data

May 13, 2005 (JP) ..... 2005-141829

(51) Int. Cl.
*B41J 29/38* (2006.01)

(52) U.S. Cl. ..... 347/5

(58) Field of Classification Search ..... None
See application file for complete search history.

(56) References Cited

U.S. PATENT DOCUMENTS

| | | | | |
|---|---|---|---|---|
| 4,774,526 | A | 9/1988 | Ito | |
| 5,163,760 | A | 11/1992 | Nardozzi | |
| 6,402,279 | B1 | 6/2002 | Torgerson et al. | |
| 6,890,048 | B2 | 5/2005 | Hirayama | |
| 7,044,572 | B2 | 5/2006 | Hirayama | |
| 2002/0118241 | A1 | 8/2002 | Fujii | |
| 2005/0206885 | A1 | 9/2005 | Kurata | |
| 2006/0109292 | A1 | 5/2006 | Sakurai | |
| 2007/0211095 | A1 * | 9/2007 | Hirayama | 347/14 |

FOREIGN PATENT DOCUMENTS

| | | |
|---|---|---|
| EP | 0 440 500 B1 | 8/1991 |

(Continued)

*Primary Examiner*—Matthew Luu
*Assistant Examiner*—Justin Seo
(74) *Attorney, Agent, or Firm*—Fitzpatrick, Cella, Harper & Scinto

(57) ABSTRACT

This invention is directed to: a printhead substrate which employs a constant current driving method and can suppress power consumption in a standby state, prevent an increase in printhead temperature, and stably discharge ink; a printhead using the printhead substrate; a head cartridge incorporating the printhead; and a printing apparatus using the printhead. The head substrate includes a plurality of printing elements; a plurality of driving elements which are provided in correspondence with the plurality of printing elements and drive the plurality of printing elements; a reference voltage generation circuit which generates a reference voltage; a reference current generation circuit which generates a first reference current on the basis of the generated reference voltage; a plurality of constant current sources, each of which generates a constant current to drive the plurality of printing elements on the basis of the generated first reference current; and a switch which controls supply of the first reference current in accordance with a printing operation.

14 Claims, 18 Drawing Sheets

FOREIGN PATENT DOCUMENTS

| | | | |
|---|---|---|---|
| EP | 1 566 271 | A | 8/2005 |
| EP | 1 579 997 | A | 9/2005 |
| JP | 2000-246900 | A | 9/2000 |
| JP | 2004-181678 | A | 7/2004 |
| JP | 2004-181679 | A | 7/2004 |
| TW | 583098 | B | 4/2004 |

* cited by examiner

HEAD SUBSTRATE, PRINTHEAD, HEAD CARTRIDGE, AND PRINTING APPARATUS

TECHNICAL FIELD

This invention relates to a head substrate, printhead, head cartridge, and printing apparatus. More particularly, this invention relates to a head substrate, printhead, head cartridge, and printing apparatus which are used to, e.g., execute printing according to an inkjet method and have a circuit to drive a printing element by supplying a predetermined current to it.

BACKGROUND ART

Conventionally, an inkjet printhead (to be referred to as a printhead hereinafter) is known which causes a heater arranged in each nozzle of the printhead to generate thermal energy, makes ink near the heater bubble by using the thermal energy, and discharges the ink from the nozzles by bubble to execute printing.

Recent inkjet printing apparatuses using the printhead are required to have high printing speed and high resolution. To meet this requirement, many nozzles are implemented in the printhead at a high density. As for driving of the heaters in the printhead, there is a demand for driving as many heaters as possible simultaneously at high speed from the viewpoint of printing speed.

Normally, a number of heaters and their driving circuit are formed on a single semiconductor substrate (this substrate will be referred to as a head substrate hereinafter). For this reason, the heater driving circuit is formed by using a MOS semiconductor process that is capable of inexpensively forming small devices at high density in a simple manufacturing process as compared to a conventional bipolar semiconductor process.

A method of driving a heater by a predetermined current has been proposed in Japanese Patent Publication Laid-Open Nos. 2004-181678 and 2004-181679 as a new heater driving method coping with the high-speed printing and MOS manufacturing process.

FIG. 18 is a block diagram showing the arrangement of a printhead heater driving circuit according to Japanese Patent Publication Laid-Open No. 2004-181679.

As is apparent from FIG. 18, the heater driving circuit comprises a reference voltage circuit 105, voltage-to-current conversion circuit 104, and current source block 106. The current source block 106 includes m heater groups each accommodating x heaters. One printhead comprises n current source blocks. Hence, one printhead comprises a total of (x×m×n) heaters.

The reference voltage circuit 105 generates a reference voltage (Vref) as the reference of the voltage-to-current conversion circuit 104. The voltage-to-current conversion circuit 104 converts a voltage to a current on the basis of the reference voltage (Vref) from the reference voltage circuit 105, i.e., generates a reference current (Iref) from the reference voltage (Vref).

On the basis of the reference current (Iref) generated by the voltage-to-current conversion circuit 104, a reference current circuit (not shown) generates a plurality of reference currents proportional to the reference current (Iref). The reference currents are supplied to the n current source blocks.

In each of the n current source blocks, on the basis of reference currents IR1 to IRn, current sources $\mathbf{103}_1$ to $\mathbf{103}_M$ output constant currents Ih1 to Ihm proportional to the reference currents supplied to the current sources.

As shown in FIG. 18, the current source block 106 comprises the (x×m) heaters, switching elements 102 as many as the heaters, and the constant current sources $\mathbf{103}_1$ to $\mathbf{103}_m$ corresponding to the m groups. The short and open states of the current between the terminals of each switching element 102 are controlled by a control signal from a control circuit of the printing apparatus main body. Each of m groups accommodates x heaters 101 and x switching elements 102. In the groups, heater resistances $\mathbf{101}_{11}$ to $\mathbf{101}_{mx}$ and switching elements $\mathbf{102}_{11}$ to $\mathbf{102}_{mx}$ for driving and controlling the heater resistances are connected in series. In the groups, power-supply-side terminals are commonly connected to a power supply line 110, and ground-side terminals are commonly connected to a GND line 111 through the constant current sources.

The output terminals of the constant current sources $\mathbf{103}_1$ to $\mathbf{103}_m$ provided for the m groups 106-1 to 106-m, respectively, are connected to the common connection terminal of the groups 106-1 to 106-m in which the heaters 101 and switching elements 102 are connected in series. Current driving control of the heaters is executed by turning on/off the switching elements 102 in the groups by a control signal. The output currents Ih1 to Ihm from the constant current sources $\mathbf{103}_1$ to $\mathbf{103}_m$ provided for the groups are supplied to desired heaters.

In an actual printhead, a plurality of (n) current source blocks 106 having the same structure are provided. The heater driving operation in each current source block 106 is the same as described above. When the same operation is executed in the n current source blocks 106, any desired heaters of the (x×m×n) heaters are driven and generate heat.

In recent inkjet printing apparatuses, to further improve the quality of printed images, the gamut is extended by using inks of many colors, or the size of ink droplets is reduced for high-resolution printing. These lead to an increase in number of nozzles that discharge inks in the printhead or an increase in number of nozzle arrays.

As described above, when heaters are driven by the constant current method, as described above, in a head substrate on which a plurality of heater arrays are arranged, the constant current source blocks to supply a predetermined current to the heaters must be arranged in arrays corresponding to the heater arrays. Hence, the number of reference currents to supply reference currents to the constant current sources increases.

When the number of reference currents increases, current consumption of the whole head substrate increases. Heat generated by the current consumption raises the temperature of the head substrate.

When the temperature of the head substrate rises, the temperature of ink that contacts the head substrate rises. This increase in temperature makes ink discharge unstable or degrades the print quality.

DISCLOSURE OF INVENTION

Accordingly, the present invention is conceived as a response to the above-described disadvantages of the conventional art.

For example, a head substrate employing a constant current drive method according to the present invention is capable of preventing an increase in printhead temperature and stably discharging ink by suppressing power consumption in a standby state without printing.

With this head substrate, a printhead which prevents an increase in printhead temperature and stably discharges ink, a head cartridge incorporating the printhead, and a printing apparatus using the printhead are implemented.

According to one aspect of the present invention, preferably, there is provided a head substrate comprising: a plurality of printing elements; a plurality of driving elements which are provided in correspondence with the plurality of printing elements and drive the plurality of printing elements; a reference voltage generation circuit which generates a reference voltage; a reference current generation circuit which generates a first reference current on the basis of the reference voltage generated by the reference voltage generation circuit; a plurality of constant current sources, each of which generates a constant current to drive the plurality of printing elements on the basis of the first reference current generated by the reference current generation circuit; and a switch which controls supply of the first reference current.

The head substrate preferably further comprises a conversion circuit which generates a plurality of second reference currents on the basis of the first reference current.

The Switch (1) may be provided in the reference current generation circuit, (2) may be provided in the conversion circuit to individually control supply of the plurality of second reference currents generated by the conversion circuit, the switch comprising switches as many as the second reference currents, or (3) may be provided in both the reference current generation circuit and the conversion circuit, like (1) and (2).

Preferably, the head substrate further comprises a detection circuit which detects presence/absence of driving of the plurality of driving elements, and the switch is ON/OFF-controlled in accordance with a detection result by the detection circuit.

In ON/OFF-controlling the switch, the plurality of printing elements and the plurality of driving elements are grouped into a plurality of groups. The plurality of constant current sources are arranged in correspondence with the plurality of groups to supply the constant current to the plurality of groups. Of the plurality of printing elements included in each of the plurality of groups, one printing element is concurrently driven at maximum.

Hence, the head substrate further comprises a shift register which serially inputs an image signal corresponding to a total of printing elements that can be driven concurrently in the plurality of groups, and a latch circuit which latches the image signal input to the shift register.

When this arrangement is used, the detection circuit determines on the basis of the image signal input to the latch circuit whether or not an image signal to drive at least one printing element is present. Alternatively, the detection circuit determines on the basis of the image signal corresponding to the concurrently drivable block whether or not an image signal to drive at least one printing element is present. If no printing element in the concurrently drivable block is to be driven, control is preferably executed such that the switch is turned off to stop supplying the current.

According to another aspect of the present invention, preferably, there is provided a printhead using the above-described head substrate.

The printhead preferably comprises an inkjet printhead which prints by discharging ink.

According to still another aspect of the present invention, preferably, there is provided a head cartridge integrating the above inkjet printhead and an ink tank containing ink supplied to the inkjet printhead.

According to still another aspect of the present invention, preferably, there is provided a printing apparatus for printing on a printing medium by discharging ink from either the above inkjet printhead or the above head cartridge.

The invention is particularly advantageous since current supply is controlled, e.g., control is performed such that current supply except the printing timing, i.e., in the standby state is stopped, power consumption in the printing operation standby state can be suppressed.

Hence, any unnecessary increase in head substrate temperature can be prevented, contributing to stable ink droplet discharge. Hence, high-quality printing can be achieved.

Other features and advantages of the present invention will be apparent from the following description taken in conjunction with the accompanying drawings, in which like reference characters designate the same or similar parts throughout the figures thereof.

BRIEF DESCRIPTION OF DRAWINGS

The accompanying drawings, which are incorporated in and constitute a part of the specification, illustrate embodiments of the invention and, together with the description, serve to explain the principles of the invention.

BEST MODE FOR CARRYING OUT THE INVENTION

Preferred embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

The term "printhead substrate (head substrate)" used below indicates not a simple substrate made of silicon semiconductor but a structure including elements and wirings.

The term "on a substrate" indicates not only "on an element substrate" but also "on the surface of an element substrate" and "inside an element substrate near the surface".

In the present invention, the term "built-in" indicates not simply arranging separate elements on a substrate surface but integrally forming and manufacturing elements on an element substrate by a semiconductor circuit manufacturing process.

In the present invention, the terms "constant current" and "constant current source" indicate a predetermined current to be supplied to printing elements regardless of a variation in the number of concurrently driven printing elements and a current source to supply the current to the printing elements. The current value itself, which should be constant, includes a value changed and set to a predetermined current value.

<Description of Inkjet Printing Apparatus (FIG. 1)>

Figure 1:
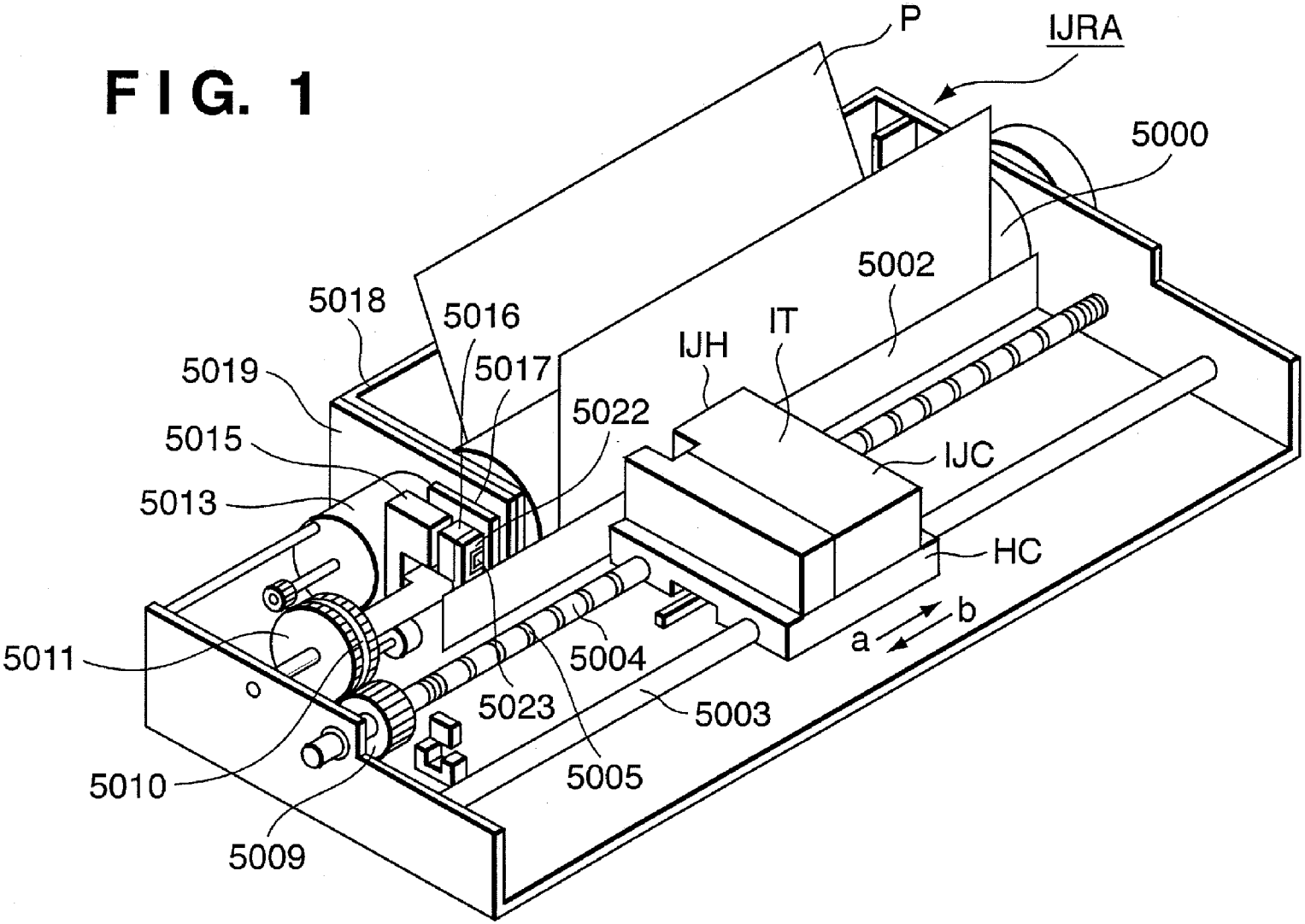
FIG. 1 is an outer perspective view showing the schematic arrangement of a part around the carriage of an inkjet printing apparatus according to a typical embodiment of the present invention.

FIG. 1 is a perspective view showing the schematic arrangement of an inkjet printing apparatus according to a typical embodiment of the present invention. Referring to FIG. 1, a lead screw 5004 rotates via driving force transmission gears 5009 to 5011 interlockingly with the forward/reverse rotation of a carriage motor 5013. A carriage HC has a pin (not shown) engaging with a helical groove 5005 of the lead screw 5004 and is reciprocally moved in the directions of arrows a and b in accordance with the rotation of the lead screw 5004 while being supported by a guide rail 5003. An inkjet cartridge IJC is mounted on the carriage HC. The inkjet cartridge IJC comprises an inkjet printhead IJH (to be referred to as a printhead hereinafter) and an ink tank IT containing ink for printing.

The inkjet cartridge IJC is integrated with the printhead IJH and ink tank IT.

A paper press plate 5002 presses a paper sheet against a platen 5000 in the moving direction of the carriage. The platen 5000 is rotated by a conveyance motor (not shown) and conveys a printing paper sheet P. A member 5016 supports a cap member 5022 that caps the front surface of the printhead. A suction means 5015 sucks the cap to perform suction recovery of the printhead through an opening 5023 in the cap. A cleaning blade 5017 and a member 5019 which moves the blade back and forth are supported by a main body support plate 5018.

Figure 2:
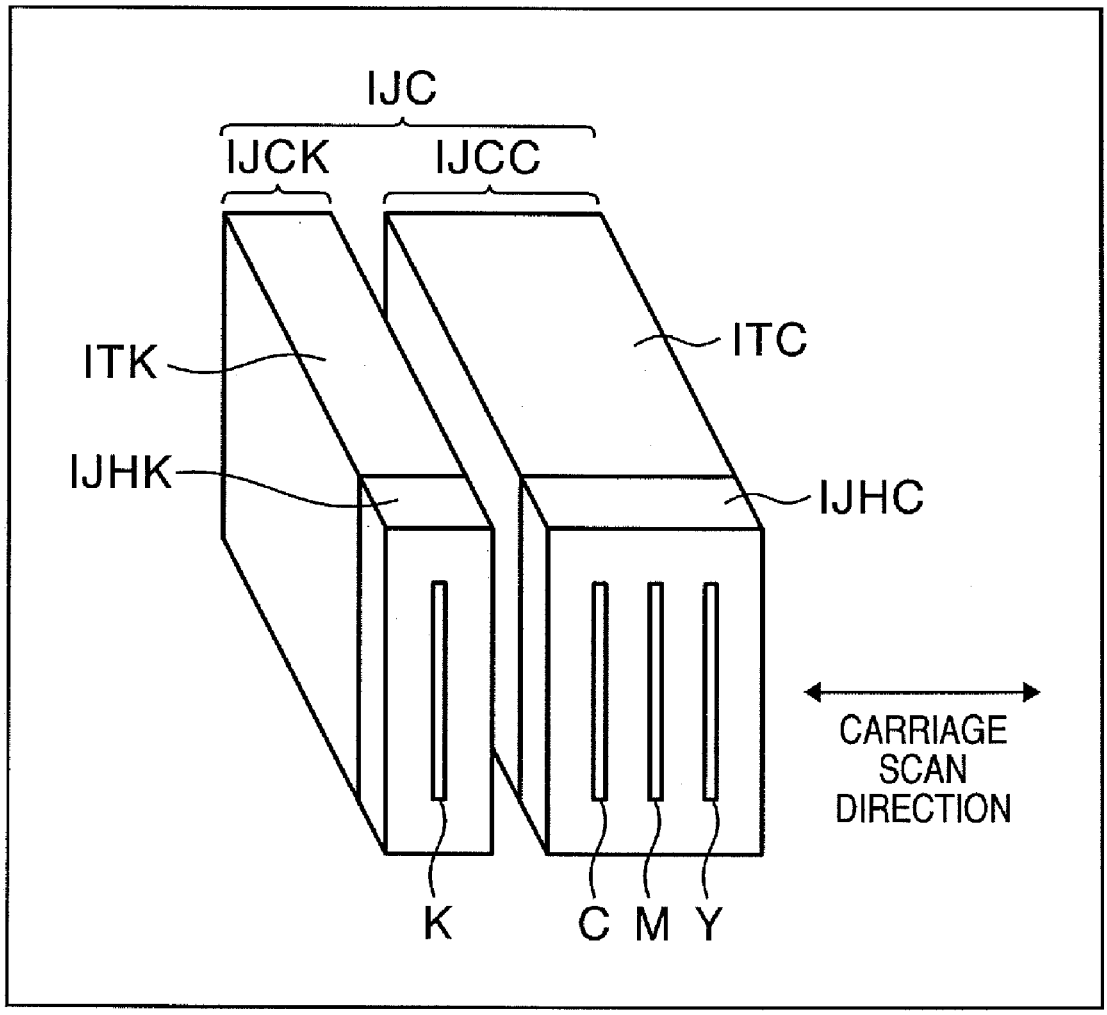
FIG. 2 is a perspective view showing the detailed structure of an inkjet cartridge IJC.

FIG. 2 is an outer perspective view showing the detailed structure of the inkjet cartridge IJC.

As shown in FIG. 2, the inkjet cartridge IJC includes a cartridge IJCK that discharges black ink, and a cartridge IJCC that discharges three color inks of cyan (C), magenta (M), and yellow (Y). The two cartridges are separable from each other and also detached from the carriage HC independently.

The cartridge IJCK includes an ink tank ITK containing black ink and a printhead IJHK that discharges the black ink for printing. The ink tank ITK and printhead IJHK are integrated. The cartridge IJCC includes an ink tank ITC containing three color inks of cyan (C), magenta (M), and yellow (Y) and a printhead IJHC that discharges these color inks for printing. The ink tank ITC and printhead IJHC are integrated. In this embodiment, the ink tanks of the cartridges are filled with the inks.

Not only the integrated cartridges IJCK and IJCC but also a cartridge in which an ink tank and a printhead are structurally separable from each other can be used.

The printhead IJH is used to comprehensively refer to both the printheads IJHK and IJHC.

As is apparent from FIG. 2, a nozzle array to discharge black ink, a nozzle array to discharge cyan ink, a nozzle array to discharge magenta ink, and a nozzle array to discharge yellow ink are arranged in the carriage moving direction. The nozzles are arrayed in a direction perpendicular or diagonal to the carriage moving direction.

Figure 3:
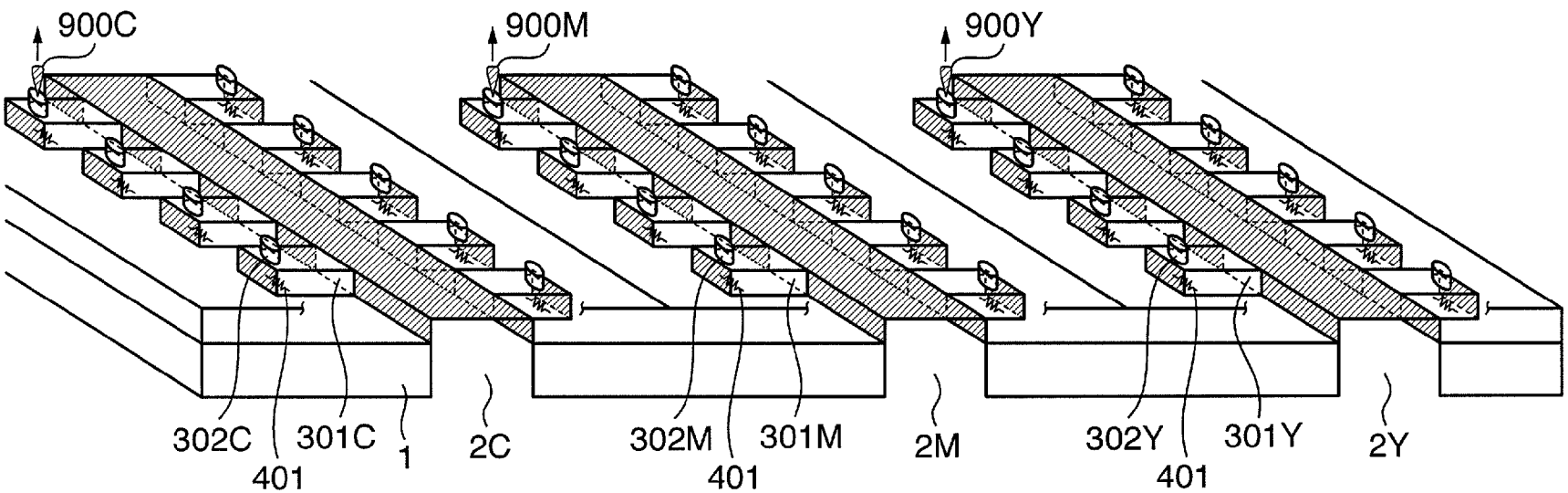
FIG. 3 is a perspective view showing the three-dimensional structure of a printhead IJHC that discharges three color inks.

FIG. 3 is a perspective view showing the three-dimensional internal structure of the printhead IJHC that discharges three color inks.

The flow of ink supplied from the ink tank ITK can be seen in FIG. 3. The printhead IJHC has an ink channel 2C to supply cyan (C) ink, an ink channel 2M to supply magenta (M) ink, and an ink channel 2Y to supply yellow (Y) ink. Supply paths (not shown) to supply the inks from the ink tank ITK to the ink channels through the rear surface of the substrate are provided.

Ink passages 301C, 301M, and 301Y are provided in correspondence with electrothermal transducers (heaters) 401. The C, M, and Y inks are guided to the electrothermal transducers (heaters) 401 provided on the substrate through the ink passages. When the electrothermal transducers (heaters) 401 are energized through a circuit to be described later, the inks on the electrothermal transducers (heaters) 401 receive heat and boil. As a result, ink droplets 900C, 900M, and 900Y are discharged from orifices 302C, 302M, and 302Y by created bubbles.

Referring to FIG. 3, electrothermal transducers (to be described later in detail), various kinds of circuits to drive them, memories, various kinds of pads serving as electrical contacts to the carriage HC, and various kinds of signal lines are formed on a printhead substrate (to be referred to as a head substrate hereinafter) 1.

One electrothermal transducer (heater) and one MOS-FET to drive it will collectively be referred to as a single printing element. A plurality of printing elements will collectively be referred to as a printing element unit.

FIG. 3 shows the three-dimensional structure of the printhead IJHC that discharges color inks. The printhead IJHK that discharges black ink also has the same structure. However, the size is ⅓ of the structure shown in FIG. 3. That is, one ink channel is present, and the scale of the head substrate is also about ⅓.

A control arrangement for executing print control of the above-described printing apparatus will be described next.

Figure 4:
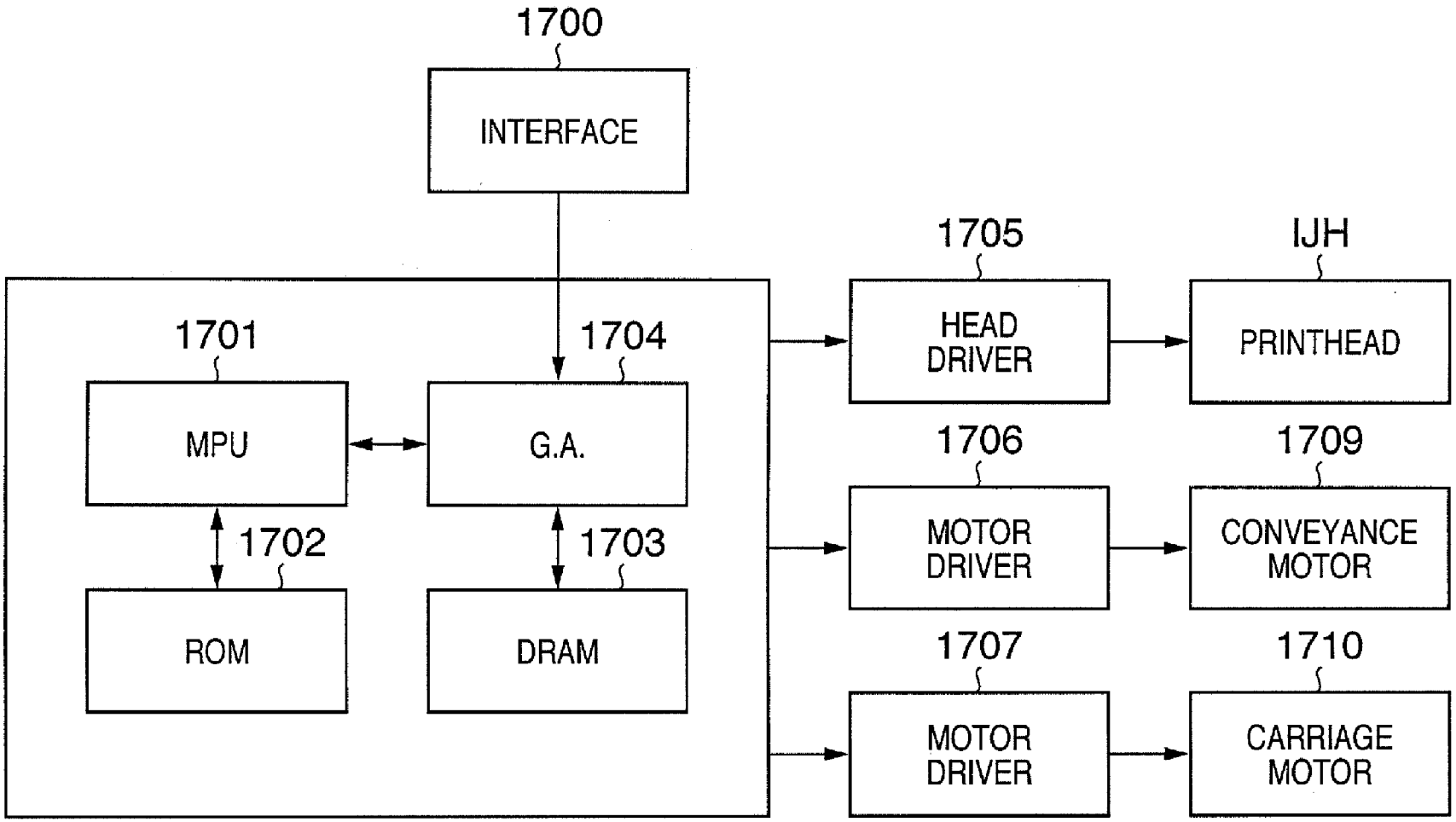
FIG. 4 is a block diagram showing the control arrangement of the printing apparatus shown in FIG. 1.

FIG. 4 is a block diagram showing the arrangement of the control circuit of the printing apparatus.

Referring to FIG. 4, reference numeral 1700 denotes an interface that inputs a print signal; 1701, an MPU; 1702, a ROM that stores a control program to be executed by the MPU 1701; 1703, a DRAM that saves various kinds of data (e.g., the print signal and print data to be supplied to the printhead). A gate array (G.A.) 1704 controls print data supply to the printhead IJH and data transfer between the interface 1700, MPU 1701, and RAM 1703.

A conveyance motor 1709 (not shown in FIG. 1) conveys the printing paper sheet P. A motor driver 1706 drives the conveyance motor 1709. A motor driver 1707 drives a carriage motor 1710. A head driver 1705 drives the printhead IJH. The head driver also outputs a logic signal serving as a control signal that variably sets a constant current value to be supplied to the heater of the printhead IJH to a predetermined value, and a control signal that controls a switch provided in, e.g., a voltage-to-current conversion circuit to generate a reference current. It should be noted that, if the switch control signal is generated in the printhead, the printing apparatus main body need not transmit the signal.

The operation of the control arrangement will be described. When a print signal is input to the interface 1700, the print signal is converted to print data for printing between the gate array 1704 and the MPU 1701. The motor drivers 1706 and 1707 are driven. In addition, the printhead IJH is driven in accordance with the print data sent to the carriage HC so that an image is printed on the printing paper sheet P.

In this embodiment, a printhead having the structure shown in FIG. 2 is used. In each carriage scan, control is executed such that printing by the printhead IJHK and that by the printhead IJHC do not overlap. In color printing, the printheads IJHK and IJHC are driven alternately in each scanning. For example, upon reciprocally scanning the carriage, control is executed such that the printhead IJHK is driven in forward scanning while the printhead IJHC is driven in backward scanning. Instead of such printhead drive control, another control may be executed such that the printing operation is done in only forward scanning, i.e., the printheads IJHK and IJHC are driven separately in two forward scanning operations without conveying the printing paper sheet P.

The structure and operation of the head substrate implemented in the printhead IJH will be described next.

First Embodiment

Figure 5:
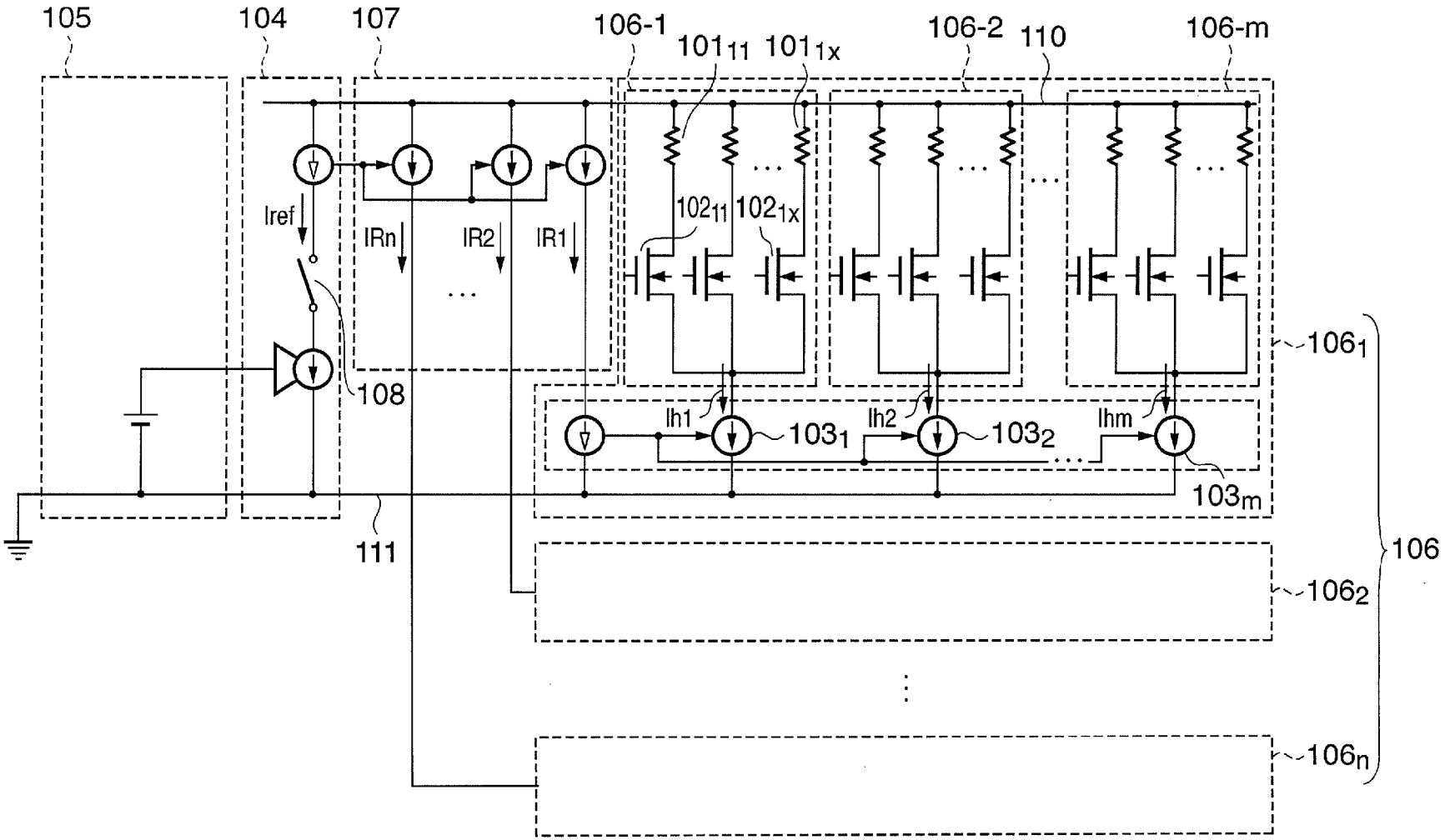
FIG. 5 is a block diagram showing the arrangement of a heater driving circuit provided on the head substrate of a printhead according to the first embodiment.

FIG. 5 is a block diagram showing the arrangement of a heater driving circuit provided on the head substrate of a printhead according to the first embodiment. The same reference numerals as in the prior art denote the same constituent elements in FIG. 5, and a description thereof will be omitted.

FIG. 5 shows a reference current circuit 107 in addition to a reference voltage circuit 105, voltage-to-current conversion circuit 104, and current source block 106. The current source block 106 comprises n current source blocks $\mathbf{106}_1$ to $\mathbf{106}n$ having the same arrangement. A switch 108 is inserted in the voltage-to-current conversion circuit 104 to ON/OFF-control a reference current (Iref).

The voltage source for the reference voltage circuit 105 preferably outputs a voltage stable with respect to the power supply voltage or a temperature change. Hence, the reference voltage circuit 105 obtains a voltage stable with respect to the power supply voltage or a temperature change by using, e.g., a bandgap voltage.

The reference current circuit 107 generates n reference currents IR1 to IRn on the basis of the reference current (Iref) generated by the voltage-to-current conversion circuit 104. In this embodiment, the reference current (Iref) is ON/OFF-controlled by controlling the switch 108. The reference currents IR1 to IRn generated on the basis of the reference current (Iref) are also ON/OFF-controlled simultaneously. Each of the n current source blocks 106 comprises m constant current sources $\mathbf{103}_1$ to $\mathbf{103}_m$ in correspondence with m groups 106-1 to 106-m each including x heaters 101 and x switching elements 102, as shown in FIG. 5.

The output terminals of the constant current sources $\mathbf{103}_1$ to $\mathbf{103}m$ provided in correspondence with the m groups 106-1 to 106-m are connected to the common connection terminals of the groups in which the heaters 101 and switching elements 102 are connected in series. Each constant current source is connected to a GND line 111.

Energization control of the heaters is executed by connecting output currents Ih1 to Ihm of the constant current sources $\mathbf{103}_1$ to $\mathbf{103}_m$ provided for the respective groups to desired heaters by switching the switching elements 102 in the groups by control signals VGi (i=1 to x).

When constant current sources that operate MOS transistors in the saturated region are used as the constant current sources $\mathbf{103}_1$ to $\mathbf{103}_m$, the power supplies can be arranged even near the heaters, i.e., in a position where the circuit layout density is high.

The operation of the heater driving circuit will be described next.

The m groups are driven and controlled by the same method. A description will be done below by exemplifying x heaters $\mathbf{101}_{11}$ to $\mathbf{101}_{1x}$ accommodated in the group 106-1 of the current source block $\mathbf{106}_1$ of the heater driving circuit shown in FIG. 5.

Figure 6:
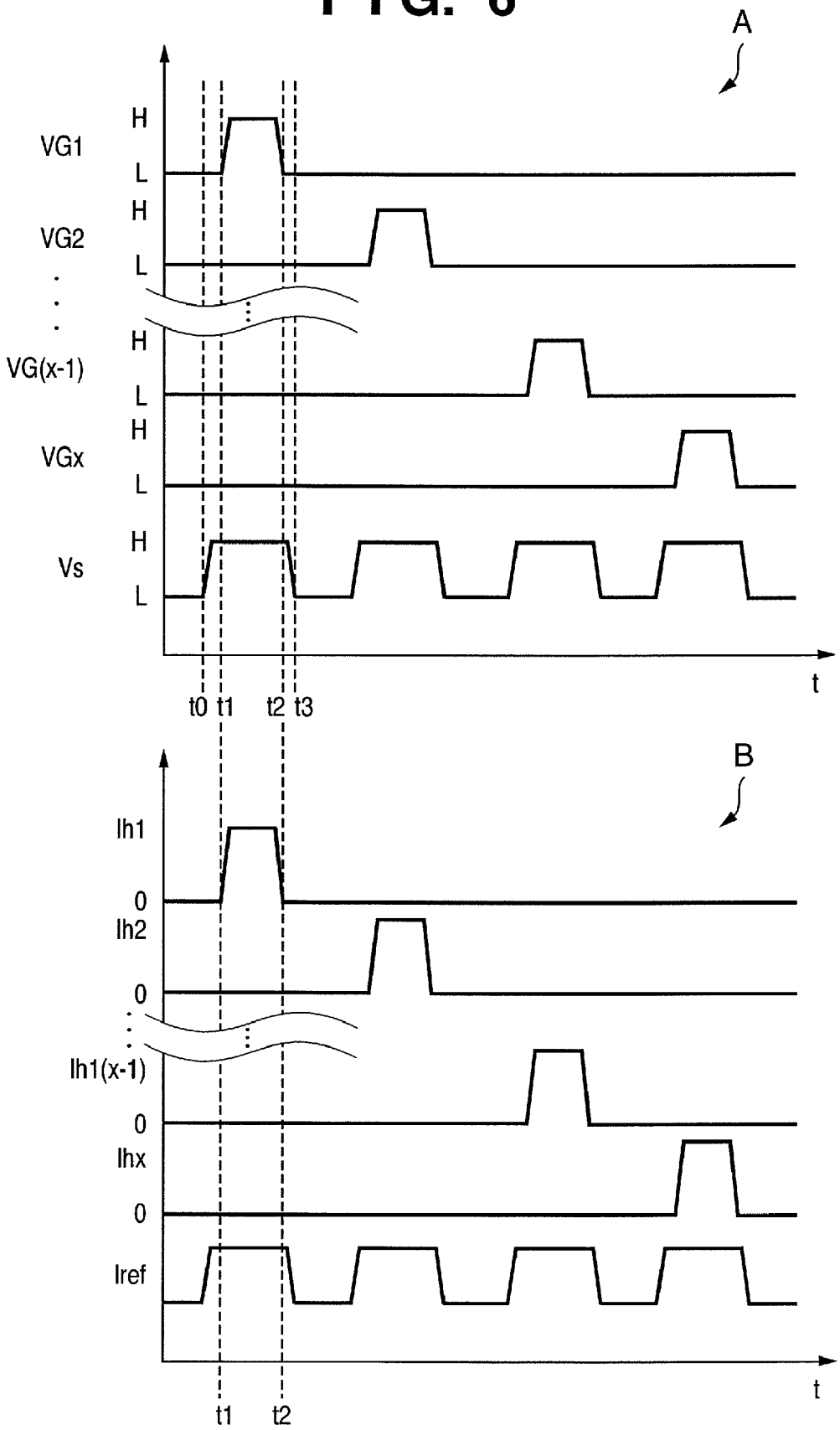
FIG. 6 is a timing chart showing the signal waveforms of gate control signals VGi applied to the control terminals of switching elements 102, a control signal Vs to control a switch 108, and time variations in the amounts of currents flowing to heaters $\mathbf{101}_{11}$ to $\mathbf{101}_{1x}$.

FIG. 6 is a timing chart showing the signal waveforms of the gate control signals VGi applied to the control terminals of switching elements 102, a control signal Vs to control the switch 108, and time variations in the amounts of currents flowing to the heaters $\mathbf{101}_{11}$ to $\mathbf{101}_{1x}$. Referring to FIG. 6, "A" indicates the signal waveforms of the gate control signals VGi applied to the control terminals of switching elements 102. "B" indicates time variations in the amounts of currents flowing to the heaters 101.

VG1 to VGx in "A" of FIG. 6 are gate control signals that controls ON (short) and OFF (open) of x switching elements $\mathbf{102}_{11}$ to $\mathbf{102}_{1x}$. When the signal level of the gate control signal VGi is high (H), the corresponding switching element 102 is turned on (electrically connected). When the signal level of the gate control signal VGi is low (L), the corresponding switching element 102 is turned off (electrically disconnected). Similarly, when the signal level of the control signal Vs is high (H), the corresponding switch 108 is turned on (electrically connected). When the signal level of the control signal Vs is low (L), the corresponding switch 108 is turned off (electrically disconnected).

In the example indicated by "A" in FIG. 6, it is assumed that all the heaters $\mathbf{101}_{11}$ to $101_{1x}$ of the group 106-1 are driven sequentially.

According to "A" in FIG. 6, at time t=t0, the control signal Vs changes to high level, the reference current (Iref) flows, and a reference current is supplied to the constant current source $\mathbf{103}_1$. During the period of t0≦t<t1, all the gate control signals VG1 to VGx are low level. Hence, the output from the constant current source $\mathbf{103}_1$ and the heaters $\mathbf{101}_{11}$ to $\mathbf{101}_{1x}$ are open. For this reason, no currents flow to the heaters $\mathbf{101}_{11}$ to $\mathbf{101}_{1x}$.

During the period of t1≦t<t2, only the gate control signal VG1 changes to high level. Hence, only the switching element $\mathbf{102}_{11}$ is short-circuited, and the output current Ih1 from the constant current source $\mathbf{103}_1$ flows to the heater $\mathbf{101}_{11}$. This state is indicated by Ih1 that rises during the period of t1≦t<t2 in "B" shown in FIG. 6.

During the period of t2≦t, the gate control signal VG1 changes to low level again, and power supply to the heater $\mathbf{101}_{11}$ stops. During the period of t3≦t, the control signal Vs changes to low level. Hence, supply of the reference current (Iref) stops, and supply of the reference current to the constant current source $\mathbf{103}_1$ stops.

As described above, during the period of t0≦t<t1 immediately before energization to the heater $\mathbf{101}_{11}$, the reference current (Iref) is supplied to the constant current source $\mathbf{103}_1$. During the period of t1≦t<t2, the current is supplied to only the heater $\mathbf{101}_{11}$ to generate heat. When energization to the heater $\mathbf{101}_{11}$ is ended, and during the period of t3≦t, supply of the reference current (Iref) stops. In this process, the ink near the heater $\mathbf{101}_{11}$ is heated to create bubbles. The ink is discharged from the nozzle in which the heater $\mathbf{101}_{11}$ is arranged so that a predetermined pixel (dot) can be printed.

Next, when the gate control signal VG2 changes to high level, the switching element $\mathbf{102}_{12}$ is short-circuited, and the output current Ih1 from the constant current source $\mathbf{103}_1$ is supplied to the heater $\mathbf{101}_{12}$). This state is indicated by Ih2 that rises in "B" shown in FIG. 6.

In this way, gate control signals VGn sequentially change to high level to sequentially turn on the switching elements $\mathbf{102}_{11}$ to $\mathbf{102}_{1x}$. The output current Ih1 from the constant current source $\mathbf{103}_1$ is sequentially supplied to the heaters $\mathbf{101}_{11}$ to $\mathbf{101}_{1x}$. All the heaters $\mathbf{101}_{11}$ to $\mathbf{101}_{1x}$ accommodated in the group 106-1 are driven.

A case where all the heaters $\mathbf{101}_{11}$ to $\mathbf{101}_{1x}$ in the group 106-1 are sequentially driven has been described as above. In an actual printing operation, however, only heaters necessary for forming desired dots are driven. Hence, only when dots are to be printed by driving desired heaters, gate control signals corresponding to the switching elements change to high level.

The above-described operation is executed in a similar manner for the heaters accommodated in the groups 106-2 to 106-m. Energization control of the heaters is executed so that any desired heaters of the (x×m) heaters can selectively be driven.

According to the above-described embodiment, a switch to ON/OFF-control reference current supply is provided in the voltage-to-current conversion circuit. When the switch is controlled by a control signal, reference current supply can be stopped at timings except when heaters are driven. For this reason, power consumption by reference current supply can effectively be suppressed.

In the above-described example, x heaters and x switching elements are commonly connected to one constant current source. However, the present invention is not limited to this.

Figure 7:
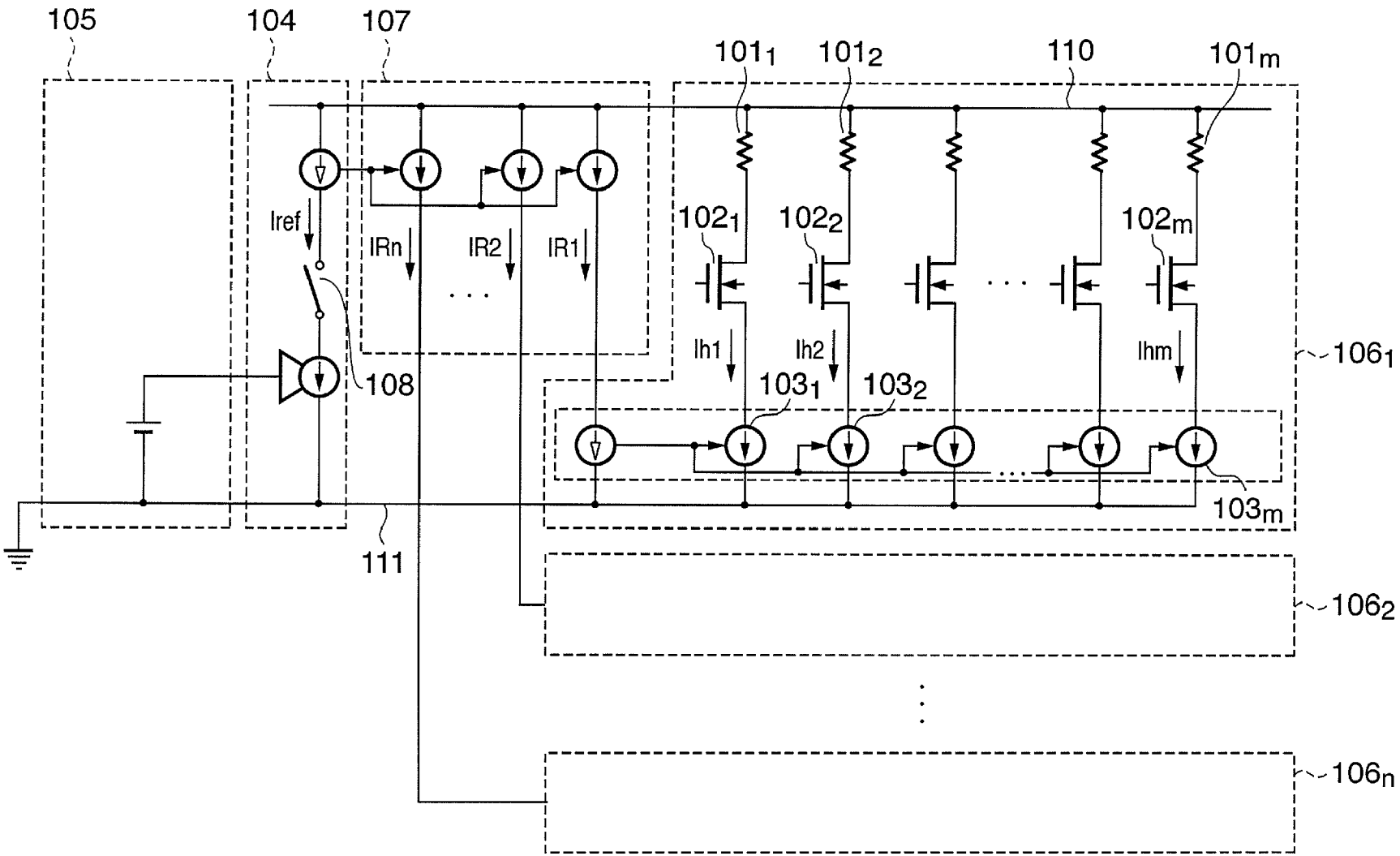
FIG. 7 is a block diagram showing the arrangement of a heater driving circuit including m current sources which are arranged in a one-to-one correspondence with m heaters and m switching elements.

For example, the present invention can also be applied to an arrangement including m current sources which are arranged in a one-to-one correspondence with m heaters and m switching elements, as shown in FIG. 7. When this arrangement is employed, all heaters or an any desired number of heaters can be driven simultaneously. Even in this case, the reference current supply timing can be set in the same way as described in FIG. 6.

Figure 8:
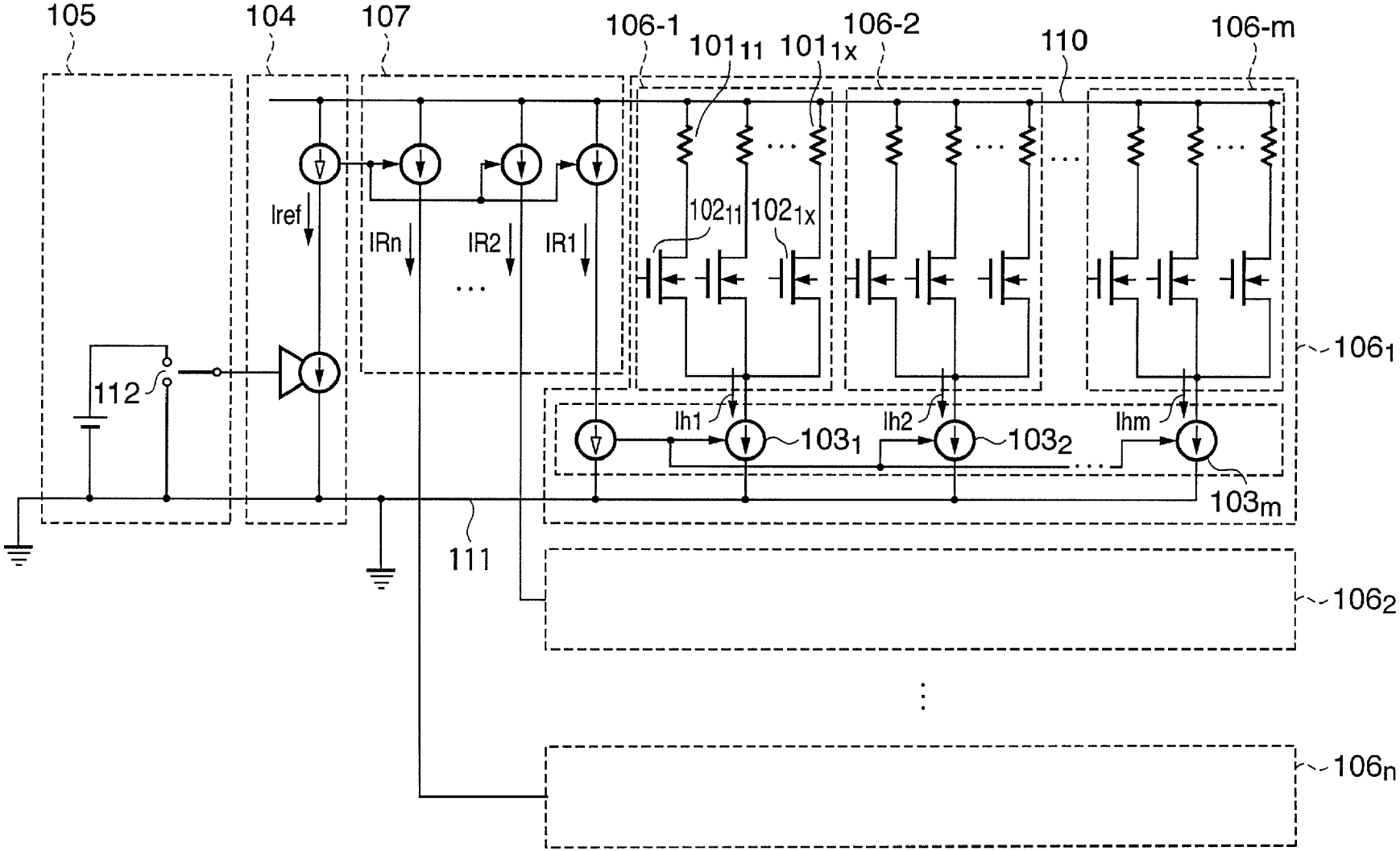
FIG. 8 is a block diagram showing the arrangement of a heater driving circuit including a switch 112 provided in a reference voltage circuit 105.

The present invention can also be applied to an arrangement including a switch 112 provided in the reference voltage circuit 105, as shown in FIG. 8. In the example shown in FIG. 8, supply control of the reference current (Iref) is executed such that supply of the reference current (Iref) is stopped by grounding a reference voltage (Vref) generated by the reference voltage circuit 105. In this case, the timing to ground the reference voltage (Vref) is preferably set in the same way as described in FIG. 6.

Second Embodiment

Figure 9:
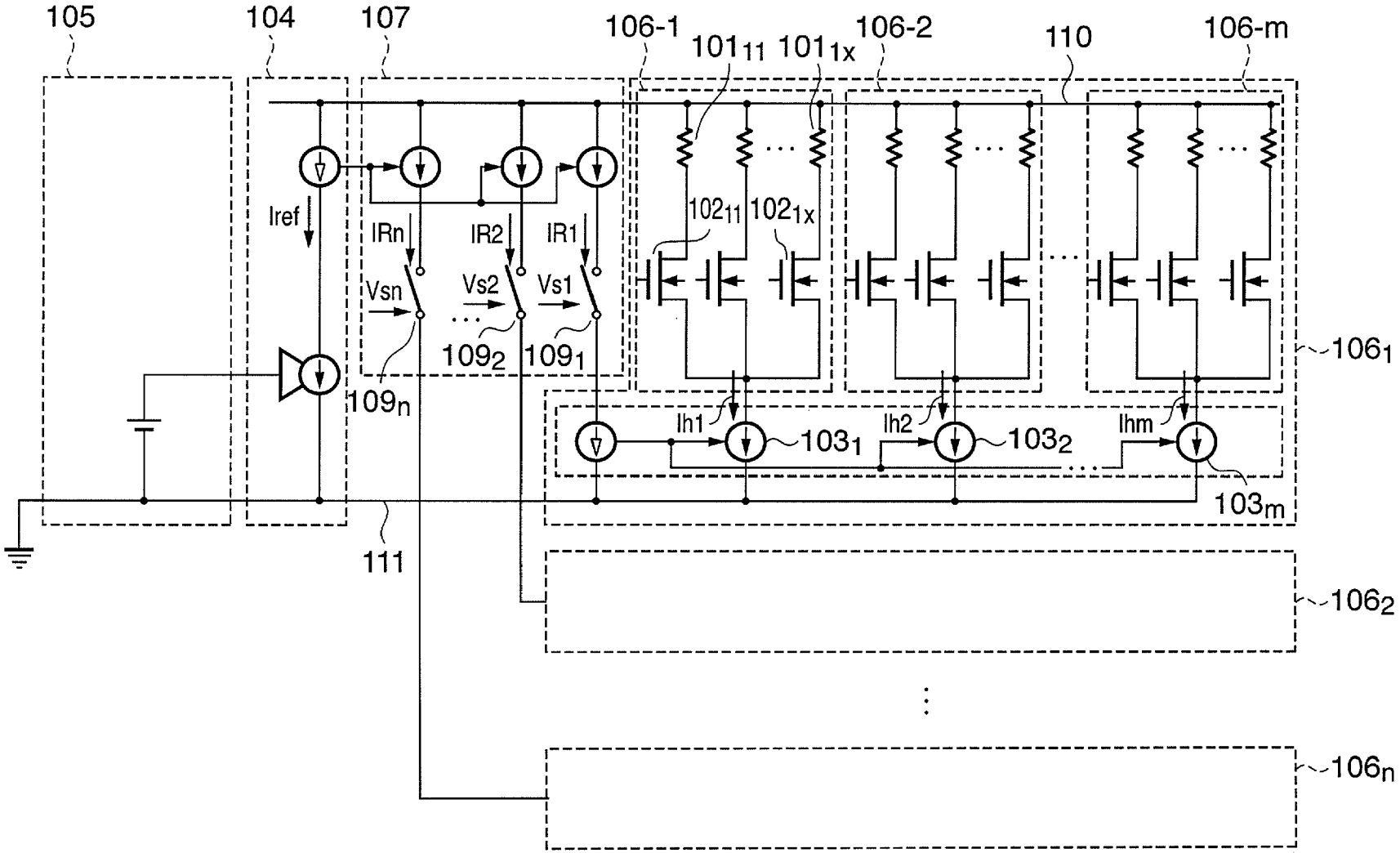
FIG. 9 is a block diagram showing the arrangement of a heater driving circuit provided on the head substrate of a printhead according to the second embodiment.

FIG. 9 is a block diagram showing the arrangement of a heater driving circuit provided on the head substrate of a printhead according to the second embodiment. The same reference numerals as in the prior art and the first embodiment denote the same constituent elements in FIG. 9, and a description thereof will be omitted.

The switch 108 of the first embodiment controls supply of the reference current (Iref). On the other hand, according to a characteristic arrangement of the second embodiment, n switches $\mathbf{109}_1$ to $\mathbf{109}_n$ are inserted in a reference current circuit 107 to control supply of a plurality of reference currents IR1 to IRn generated on the basis of a reference current (Iref) generated by a voltage-to-current conversion circuit 104.

Hence, according to this embodiment, energization control is executed such that the reference currents IR1 to IRn are supplied to any desired switches by control signals Vs1, Vs2, . . . , Vsn supplied to the switches $\mathbf{109}_1$ to $\mathbf{109}_n$.

The operation of the heater driving circuit will be described next.

M groups are driven and controlled in the same manner as described before. A description will be done below by exemplifying x heaters $\mathbf{101}_{11}$ to $\mathbf{101}_{1x}$ accommodated in a group 106-1 of a current source block 106 of the heater driving circuit shown in FIG. 9.

Figure 10:
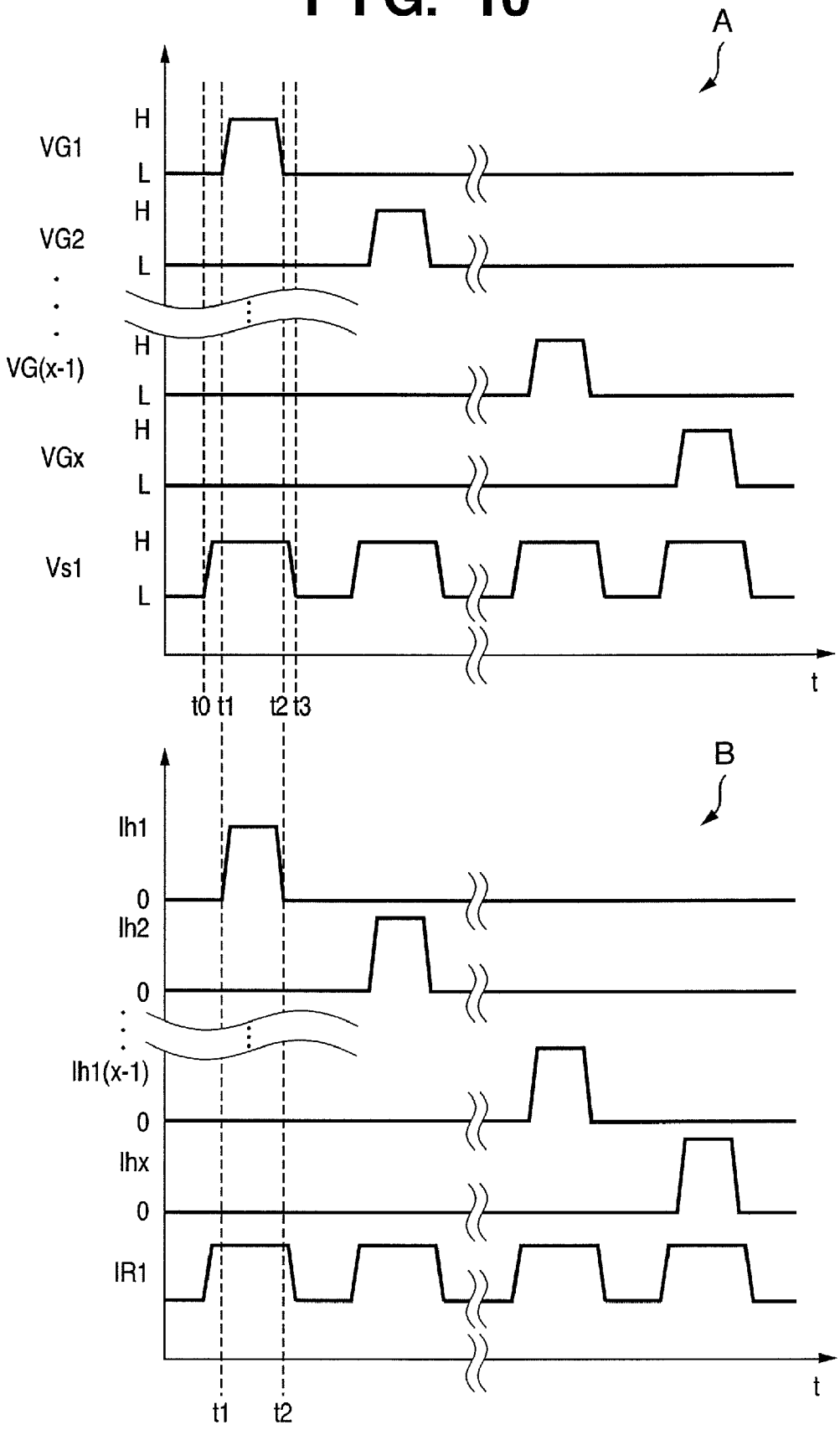
FIG. 10 is a timing chart showing the signal waveforms of gate control signals VGi applied to the control terminals of switching elements 102, a control signal Vs1 to control a switch $\mathbf{109}_1$, and time variations in the amounts of currents flowing to heaters $\mathbf{101}_{11}$ to $\mathbf{101}_{1x}$.

FIG. 10 is a timing chart showing the signal waveforms of gate control signals VGi applied to the control terminals of switching elements 102, a control signal Vs1 to control the switch $\mathbf{109}_1$, and time variations in the amounts of currents flowing to the heaters $\mathbf{101}_{11}$ to $\mathbf{101}_{1x}$. Referring to FIG. 10, "A" indicates the signal waveforms of the gate control signals VGi applied to the control terminals of the switching elements 102. "B" indicates time variations in the amounts of currents flowing to the heaters $\mathbf{101}_{11}$ to $\mathbf{101}_{1x}$. The same reference symbols as in the first embodiment denote the same signals and operations in FIG. 10, and a description thereof will be omitted.

As is apparent from comparison between "A" and "B" in FIG. 10 and "A" and "B" in FIG. 6, the control signal Vs1 and reference current IR1 to control the switch $\mathbf{109}_1$ are used to drive and control the heaters belonging to the current source block $\mathbf{106}_1$.

According to "A" and "B" in FIG. 10, during the period of t0≦t<t1 immediately before energization to the heater $\mathbf{101}_{11}$, the reference current IR1 is supplied to a current source $\mathbf{103}_1$. During the period of t1≦t<t2, the current is supplied to only the heater $\mathbf{101}_{11}$ to generate heat. When energization to the heater $\mathbf{101}_{11}$ is ended, and during the period of t3≦t, supply of the reference current IR1 stops. In other words, during the period when the control signal Vs1 is low level, supply of the reference current IR1 is stopped.

Figure 11:
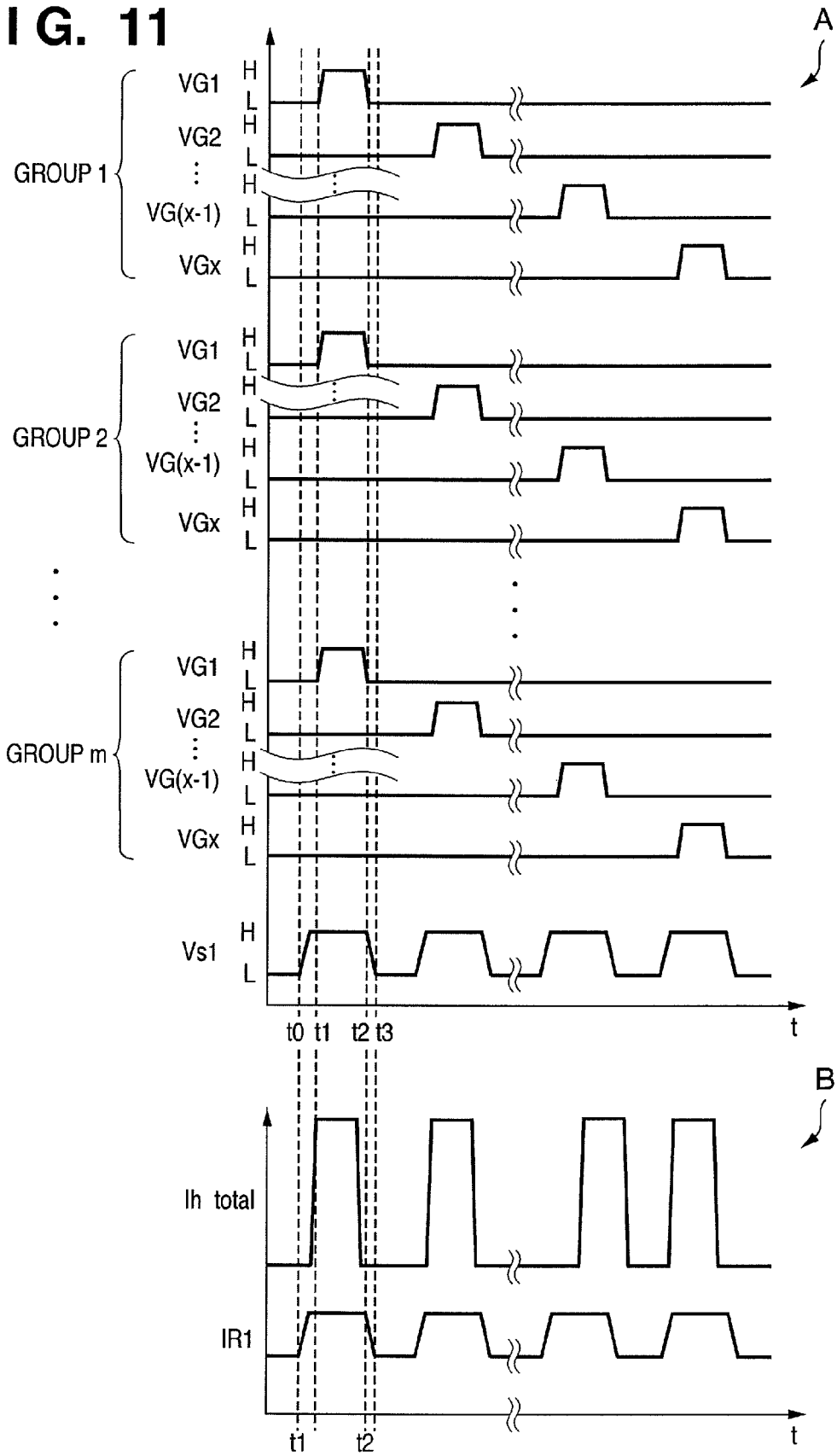
FIG. 11 is a timing chart showing the driving timing of m groups.
Figure 12:
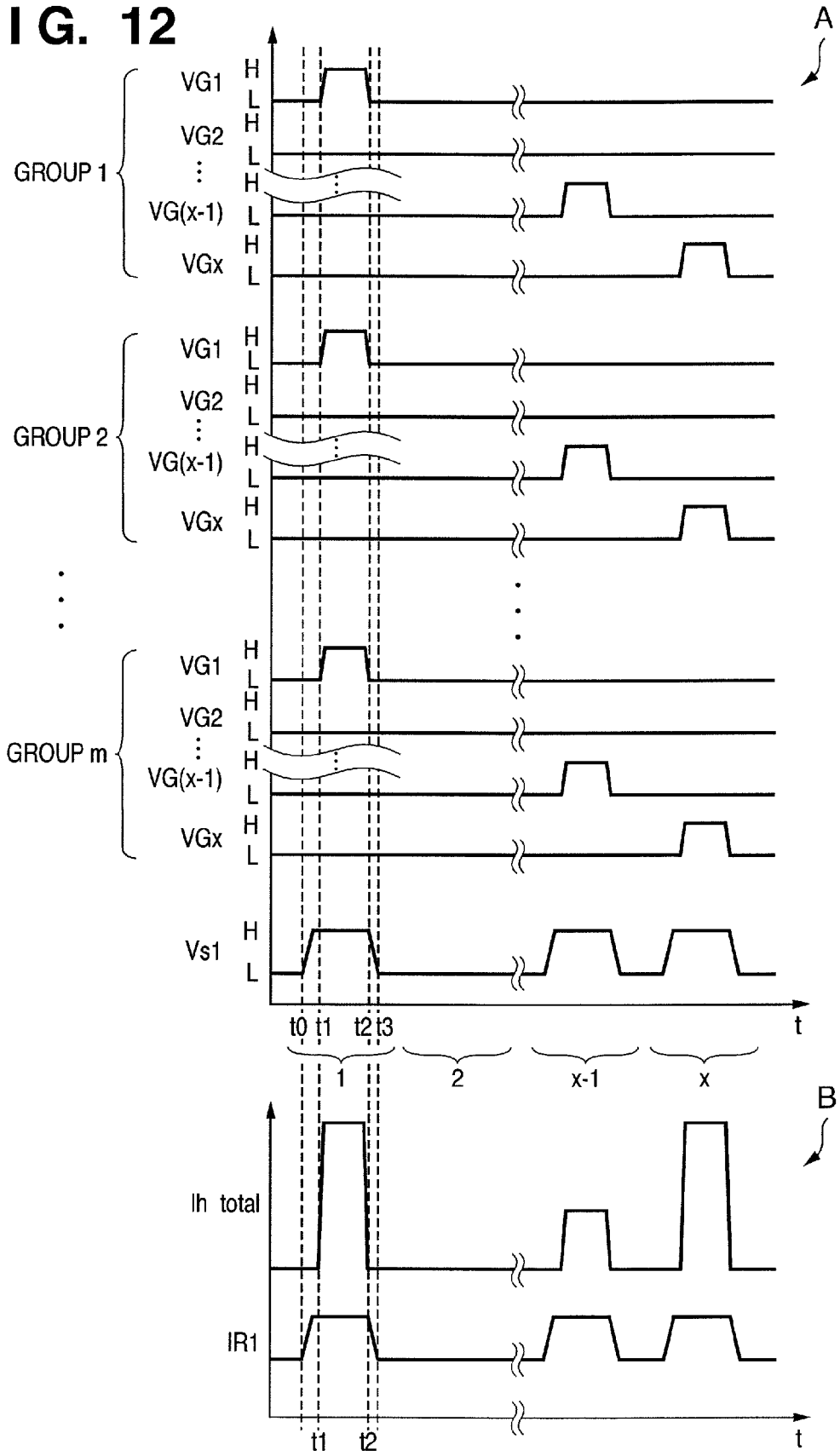
FIG. 12 is a timing chart showing the driving timing of m groups.

FIGS. 11 and 12 are timing charts showing the driving timing of the m groups.

FIG. 11 shows an example where all heaters in the m groups belonging to the constant current block 106 are sequentially driven. FIG. 12 shows an example where the heaters are driven in accordance with an input image signal as in an actual printing operation.

The driving timing of the x heaters included in each group is controlled such that two or more heaters are not driven simultaneously. Hence, the maximum number of heaters to be concurrently driven in the constant current source block $\mathbf{106}_1$ is m. At this time, current consumption of the heater current (Ih total) and reference current IR1 per unit time reach their maximum. When n constant current source blocks are present, as shown in FIG. 9, the number of reference currents and the number of heaters increase to n times. The maximum current consumption also increases to n times.

To the contrary, in an actual printing operation, heaters are driven in accordance with an input image signal. Hence, at some timings, none of the heaters under the constant current source block $\mathbf{106}_1$ are driven depending on the image signal.

FIG. 12 shows a case where none of the heaters under the current source block are driven at some timings. The heater driving timing is divided into x along the time axis (t) of "A" of FIG. 12. At the second timing, none of the heaters $\mathbf{101}_{12}$, $\mathbf{101}_{22}, \ldots, \mathbf{101}_{m2}$ in the groups 106-1 to 106-m are driven. No heaters of the constant current source blocks are driven at this timing. For this reason, control is executed while keeping supply of the reference current IR1 stopped by a control signal from a detection circuit (to be described later) or a signal from the printhead. The reference current IR1 and heater current (Ih total) at this time are shown by "B" in FIG. 12.

The above-described operation is executed in a similar manner for remaining constant current source blocks $\mathbf{106}_2$ to $\mathbf{106}_n$.

A detection circuit that detects presence/absence of heater driving of each constant current source block will be described next.

Figure 13:
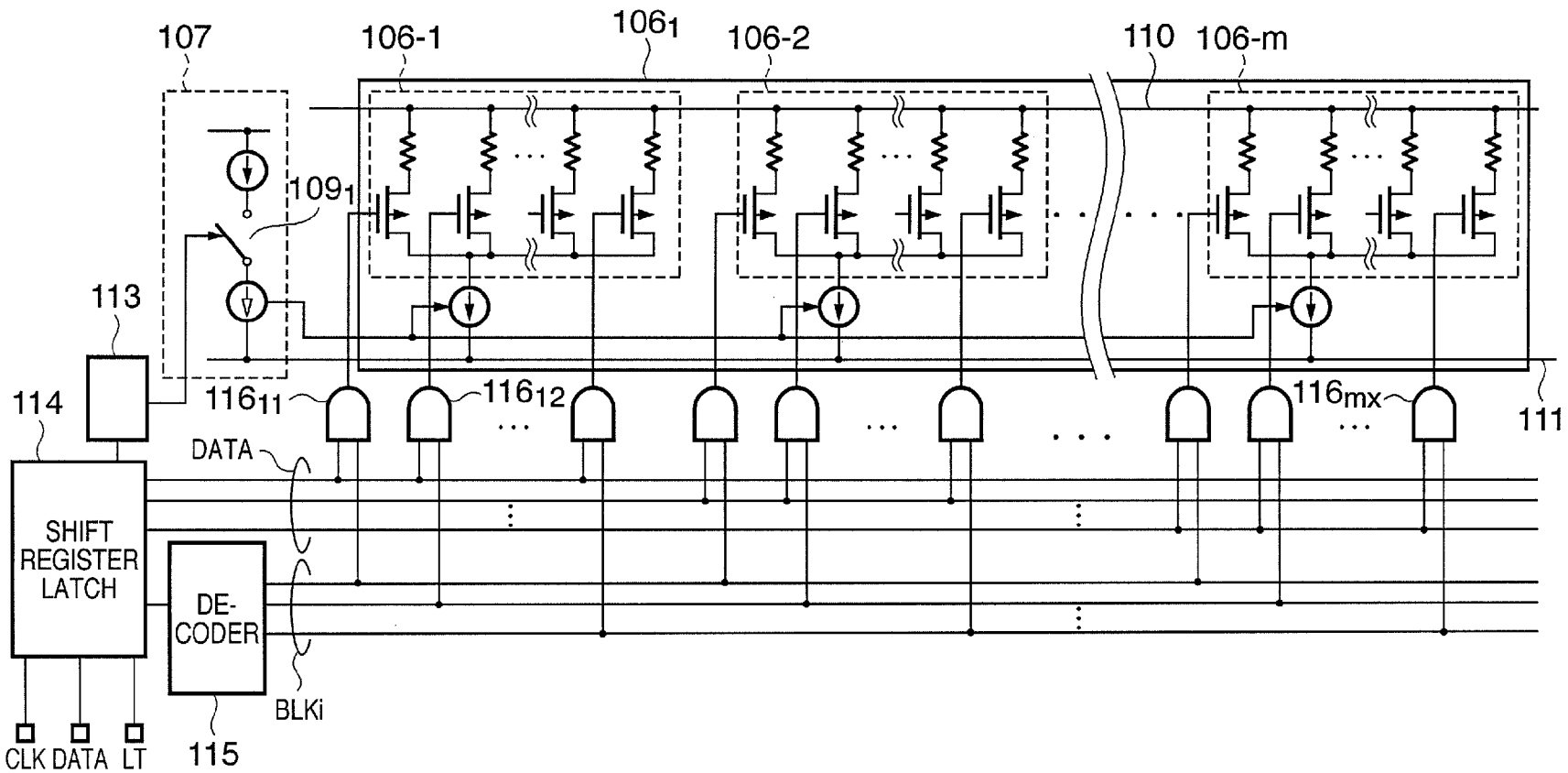
FIG. 13 is a block diagram showing the relationship between a constant current block $\mathbf{106}_1$, its associated heater driving control circuit, and a detection circuit.

FIG. 13 is a block diagram showing the relationship between the constant current block $\mathbf{106}_1$, its associated heater driving control circuit, and a detection circuit.

An image signal (DATA) related to ON/OFF of the (x×m) heaters belonging to the m groups 106-1 to 106-m to which the constant current block $\mathbf{106}_1$ supplies a current is input to a shift register in synchronism with a clock signal (CLK). The image signal input to the shift register is latched by a latch circuit in accordance with a latch signal (LT) and input to a decoder 115. The image signal (DATA) output from the latch circuit and a time division signal (BLK) output from the decoder 115 are input to (x×m) AND circuits $\mathbf{116}_{11}$ to $\mathbf{116}_{mx}$ corresponding to the (x×m) switching elements, as shown in FIG. 13, and ANDed. The calculation results are input to the gates of the switching elements. Heaters of the constant current block $\mathbf{106}_1$ are selected in accordance with the calculation results.

Note that the signal input to the shift register is input to a detection circuit 113. Referring to FIG. 13, the shift register and latch circuit are denoted by the same reference numeral 114.

Figure 14:
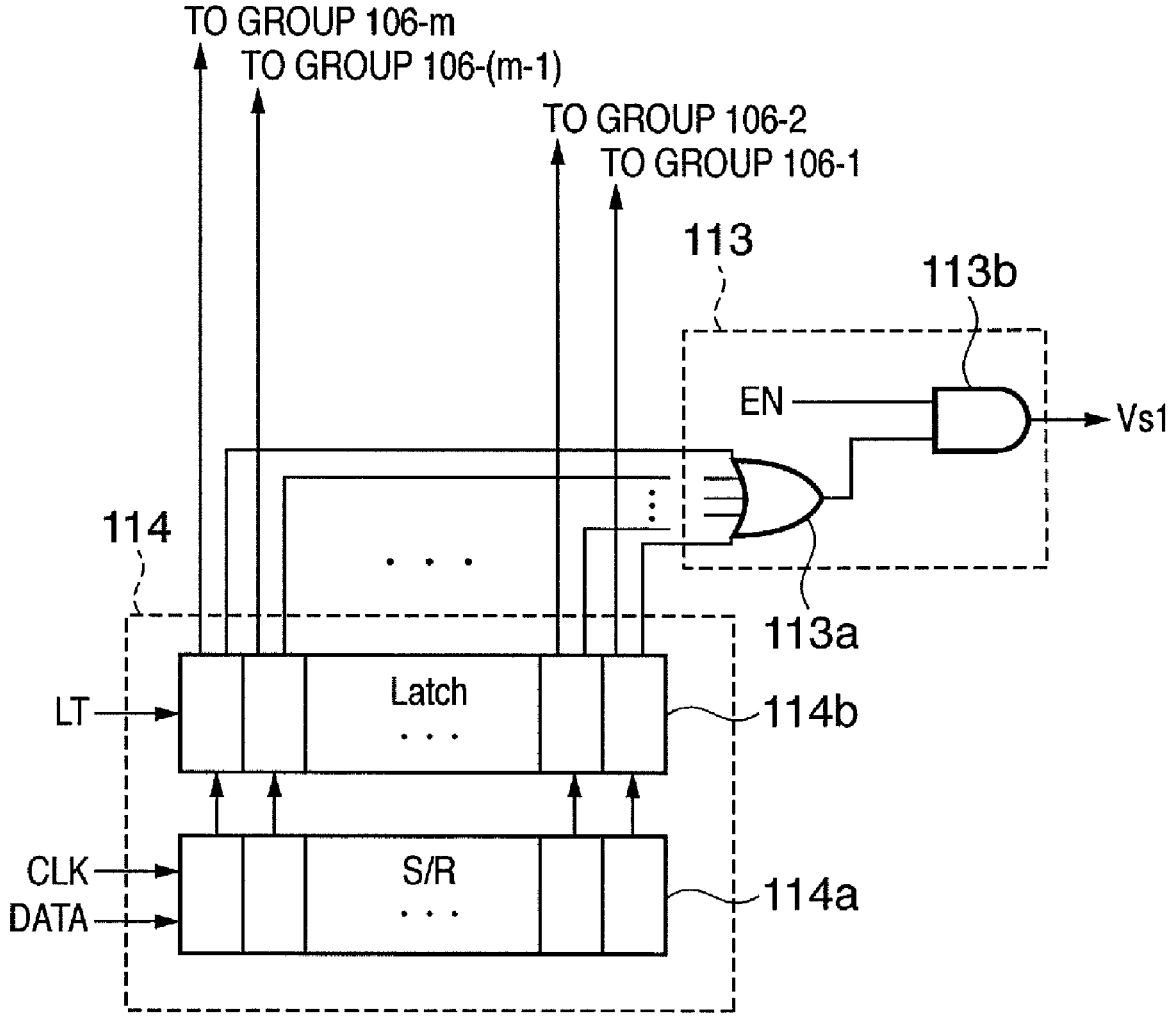
FIG. 14 is a block diagram showing an arrangement of the detection circuit.

FIG. 14 is a block diagram showing an arrangement of the detection circuit.

A shift register (SIR) 114*a* shown in FIG. 14 includes m registers and stores image data corresponding to driving of m heaters of the heaters to which a current is supplied from the constant current source block $\mathbf{106}_1$. The outputs from the shift register 114*a* are input to latch circuits 114*b* in parallel. Each of the output bits from the latch circuits 114*b* is input to one terminal of the AND circuit connected to the switching element belonging to a corresponding one of the m groups 106-1 to 106-m of the constant current source block $\mathbf{106}_1$.

The output bits from the latch circuits 114*b* are also connected to the inputs of an OR circuit 113*a* in the detection circuit 113. The output from the OR circuit 113*a* is input to an AND circuit 113*b*. An EN signal to determine the timing of the control signal Vs1 that ON/OFF-controls the switch $\mathbf{109}_1$ is input to the other input to the AND circuit 113*b*. In this way, the control signal Vs1 is generated as the output signal from the AND circuit 113*b* and supplied to the switch $\mathbf{109}_1$ that controls supply of the reference current IR1.

This detection circuit operates in the following way.

The image signal (DATA) corresponding to heater driving of the constant current source block $\mathbf{106}_1$ is input from the printing apparatus main body to the shift registers 114*a* serially in synchronism with the clock signal (CLK). M image signal bits corresponding to M heaters are stored in the shift registers 114*a*. The M image signal bits are input to the latch circuits 114*b* in parallel at the input timing of the latch signal (LT) and held. The image signal bits output from the latch circuits 114*b* are used to generate gate control signals of the switching elements of the heaters in the groups 106-1 to 106-m. At the same time, the m-bit image signal is input to the OR circuit 113*a* and used as information to detect whether to drive the heaters of the constant current block $\mathbf{106}_1$.

According to the circuit arrangement shown in FIG. 14, when at least one heater in the groups 106-1 to 106-m is to be driven, the output from the OR circuit 113*a* is high level. This output is input to the AND circuit 113*b*. If the EN signal for determining the supply timing of the reference current is high level, the reference current IR1 is supplied at timings when driving the heaters. On the other hand, if no heaters of the groups 106-1 to 106-m are to be driven, the output from the OR circuit 113*a* remains low level. The reference current IR1 is not supplied regardless of the signal level of the EN signal. This state corresponds to the second timing of "A" in FIG. 12 described above and suppresses power consumption by the reference current IR1 in the constant current block $\mathbf{106}_1$.

When such a detection circuit is provided in each of the constant current source blocks $\mathbf{106}_2$ to $\mathbf{106}_n$, the presence/absence of heater driving corresponding to each constant current source block can be detected. With this arrangement, supply of the reference currents IR2 to IRn is controlled, thereby suppressing power consumption.

As described above, if the arrangement for detecting the presence/absence of heater driving of the constant current source blocks is not present, the reference currents IR1 to IRn of the entire circuit simultaneously flow to all blocks upon driving the heaters. To the contrary, in a case where the arrangement capable of detecting the presence/absence of heater driving of the constant current source blocks is present, when at least one heater of each constant current source block is to be driven, an n-times reference current flows at maximum instantaneously. However, when there is a timing not to execute heater driving of the constant current source blocks at all, the reference current supplied to the constant current source block can be suppressed to zero. Hence, the total number of reference currents used in the printing operation can be decreased in accordance with the input image signal.

According to the above-described embodiment, the same effect as in the first embodiment can be obtained by controlling the switches $\mathbf{109}_1$ to $\mathbf{109}_n$ in the same way as in controlling the switch 108 of the first embodiment. In addition, in a case where heater driving is not executed in at least one of the n constant current source blocks $\mathbf{106}_1$ to $\mathbf{106}_n$ at a given timing, reference current supply to such a current source block is stopped, thereby making power consumption lower than in the first embodiment. Hence, the increase in head substrate temperature can be suppressed more effectively.

Note that the arrangement of the detection circuit is not limited to that shown in FIG. 14.

Figure 15:
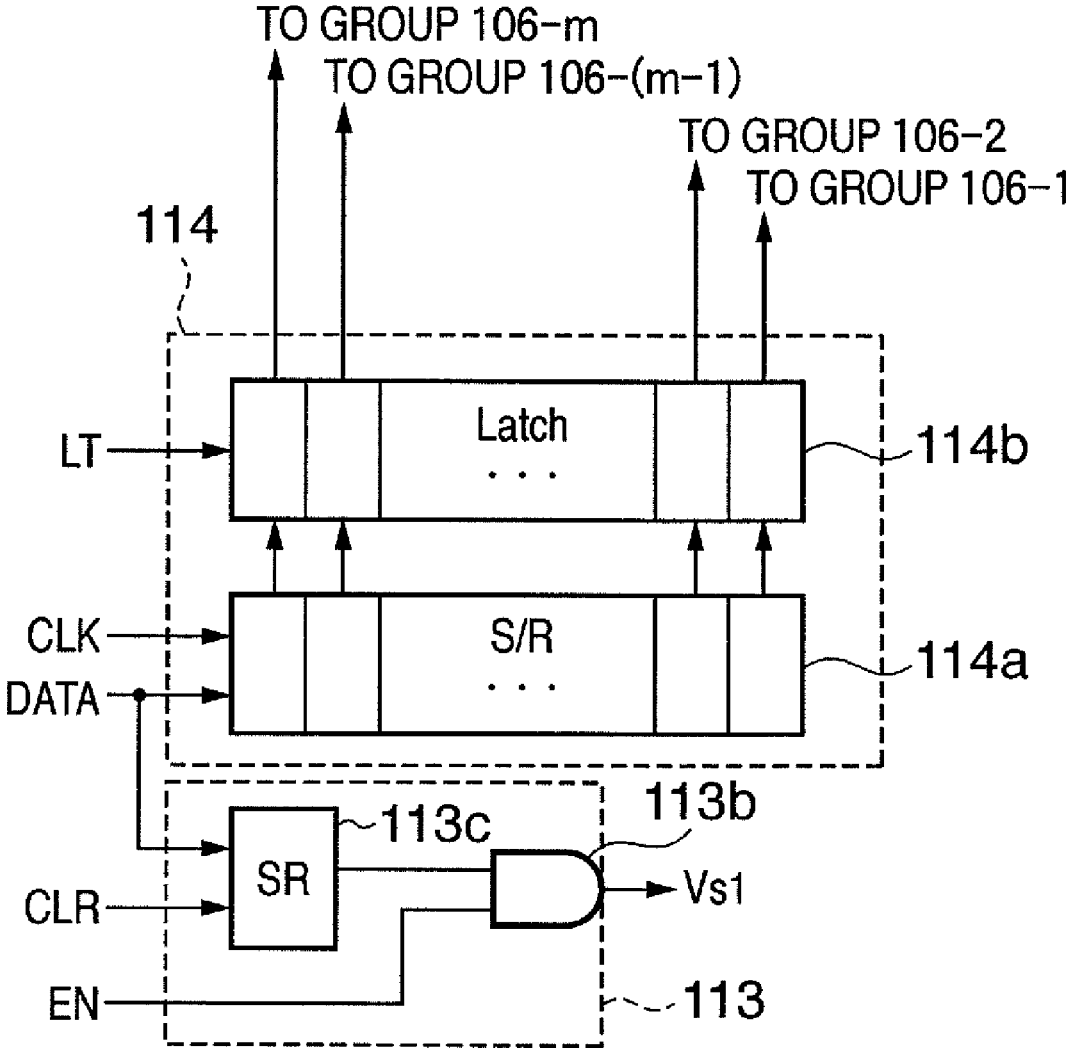
FIG. 15 is a block diagram showing another arrangement of the detection circuit.

FIG. 15 is a block diagram showing another arrangement of the detection circuit.

According to this arrangement, the image signal (DATA) is also input to the set terminal of a set/reset (SR) circuit 113*c*. The set/reset (SR) circuit 113*c* includes a single flip-flop circuit. The image signal (DATA) is input to the clock input terminal. Once a signal of high level is input as the image signal, a high-level signal is output from the output terminal until a clear signal (CLR) is input to the clear terminal.

In this detection circuit, before input of the image signal (DATA), the clear signal (CLR) is input to reset the output signal from the set/reset (SR) circuit 113*c* to low level. Then, m image signal bits are input to the shift registers 114*a* serially and also input to the set/reset (SR) circuit 113*c*.

When at least one of the m image signal bits is high level, i.e., the image signal should drive at least one heater, the output from the set/reset (SR) circuit 113*c* changes to high level. At this timing, at least one of the m heaters drivable upon receiving a current from the constant current source block $\mathbf{106}_1$ is to be driven. Hence, the reference current IR1 is supplied in accordance with the input EN signal. To the contrary, if none of the m image signal bits is to drive the heaters, the output of the set/reset signal is kept reset by the clear signal (CLR), i.e., remains low level. As a result, the reference current IR1 is not supplied.

When such a detection circuit is provided in each of the constant current source blocks $\mathbf{106}_2$ to $\mathbf{106}_n$, like the detection circuit shown in FIG. 14, the presence/absence of heater driving corresponding to each constant current source block can be detected. With this arrangement, supply of the reference currents IR2 to IRn is controlled, thereby suppressing power consumption. In the circuit arrangement shown in FIG. 15, the configuration of the set/reset circuit does not change even when the number of bits of the input image signal increases. For this reason, this circuit arrangement can prevent any increase in the circuit scale related to detection even when the number of bits of the input image signal increases, unlike the detection circuit arrangement shown in FIG. 14. This means that the layout area necessary for implementing the detection circuit is constant regardless of the increase in the number of bits of the input image signal. This contributes to suppressing the cost of the head substrate.

In the above description, the detection circuit is provided on the head substrate. However, the present invention is not limited to this. The detection circuit may be provided on, e.g., the substrate of the control circuit of the printing apparatus main body or the carriage substrate with the printhead being mounted as far as the detection circuit can detect heater driving information.

Third Embodiment

Figure 16:
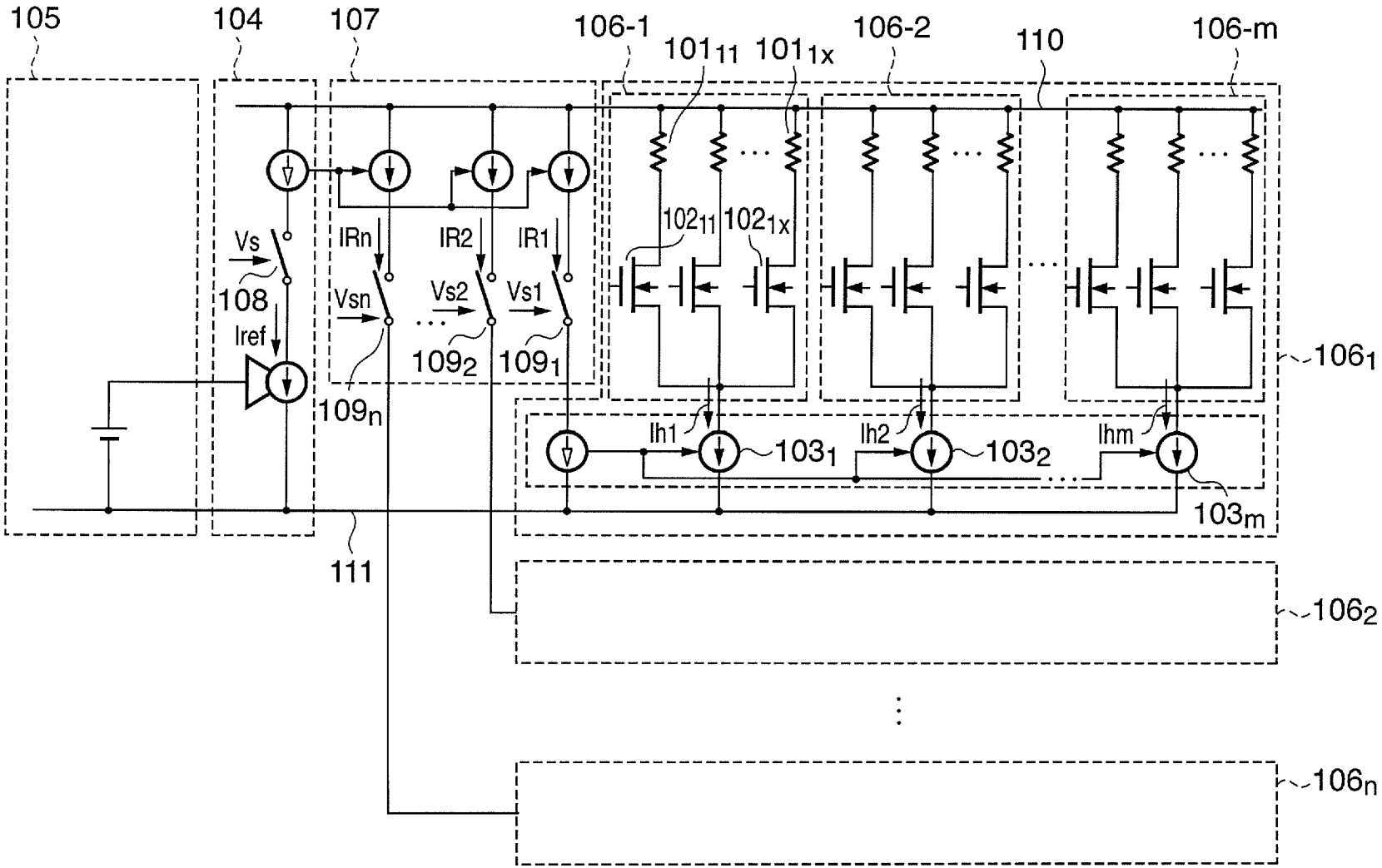
FIG. 16 is a block diagram showing the arrangement of a heater driving circuit provided on the head substrate of a printhead according to the third embodiment.

FIG. 16 is a block diagram showing the arrangement of a heater driving circuit provided on the head substrate of a printhead according to the third embodiment. The same reference numerals as in the prior art and first and second embodiments denote the same constituent elements in FIG. 16, and a description thereof will be omitted.

According to the first embodiment, the switch 108 to control supply of the reference current (Iref) is provided in the voltage-to-current conversion circuit 104. According to the second embodiment, the n switches $\mathbf{109}_1$ to 109*n* to control supply of the plurality of reference currents IR1 to IRn generated on the basis of the reference current (Iref) generated by the voltage-to-current conversion circuit 104 are provided in the reference current circuit 107. According to a characteristic arrangement of the third embodiment, switches to control supply of a reference current (Iref) and reference currents IR1 to IRn are provided in both a voltage-to-current conversion circuit 104 and a reference current circuit 107.

Figure 17:
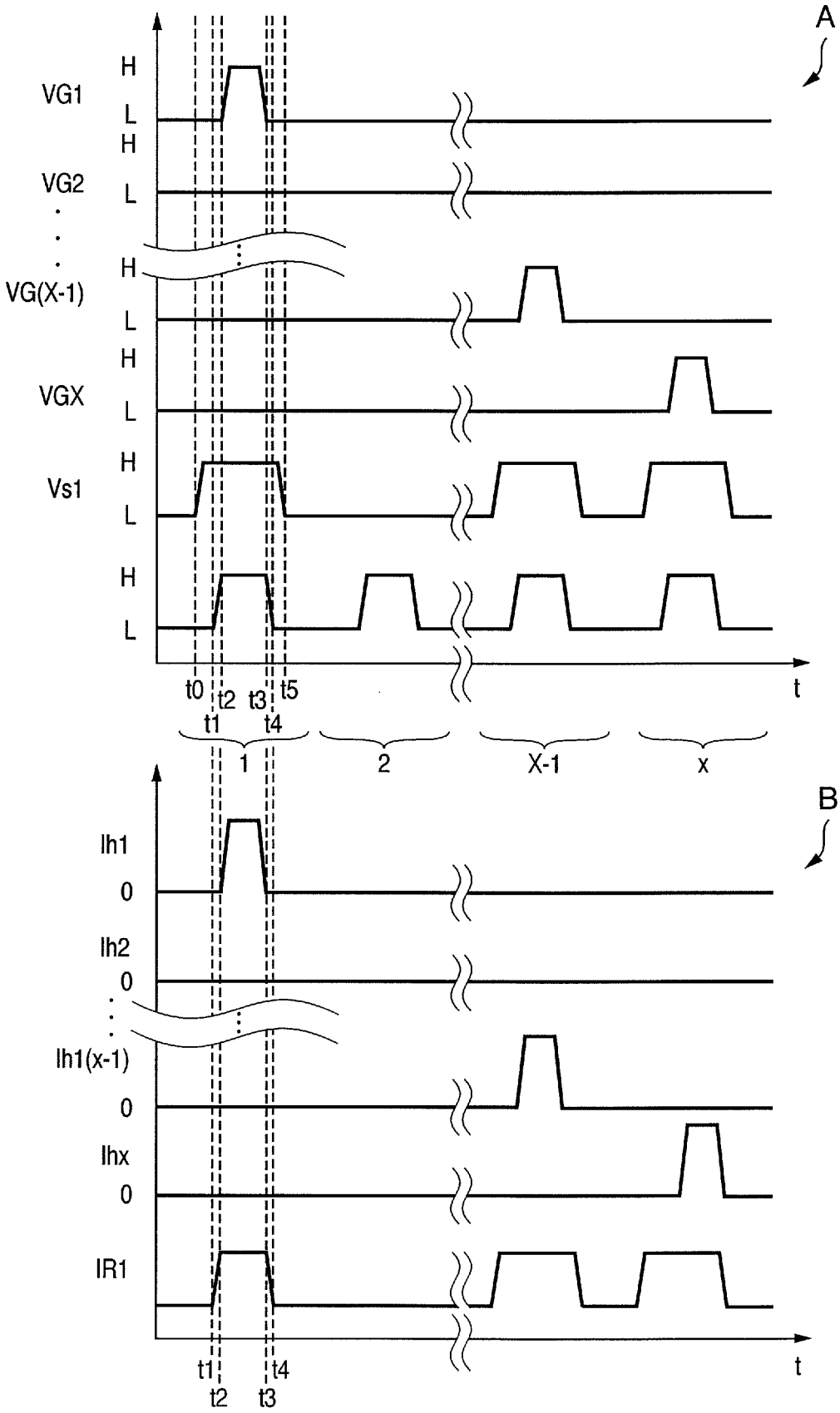
FIG. 17 is a timing chart showing the signal waveforms of gate control signals VGi applied to the control terminals of switching elements 102, a control signal Vs1 to control a switch $\mathbf{109}_1$, a control signal Vs to control a switch 108, and time variations in the amounts of currents flowing to heaters $\mathbf{101}_{11}$ to $\mathbf{101}_{1x}$.
Figure 18:
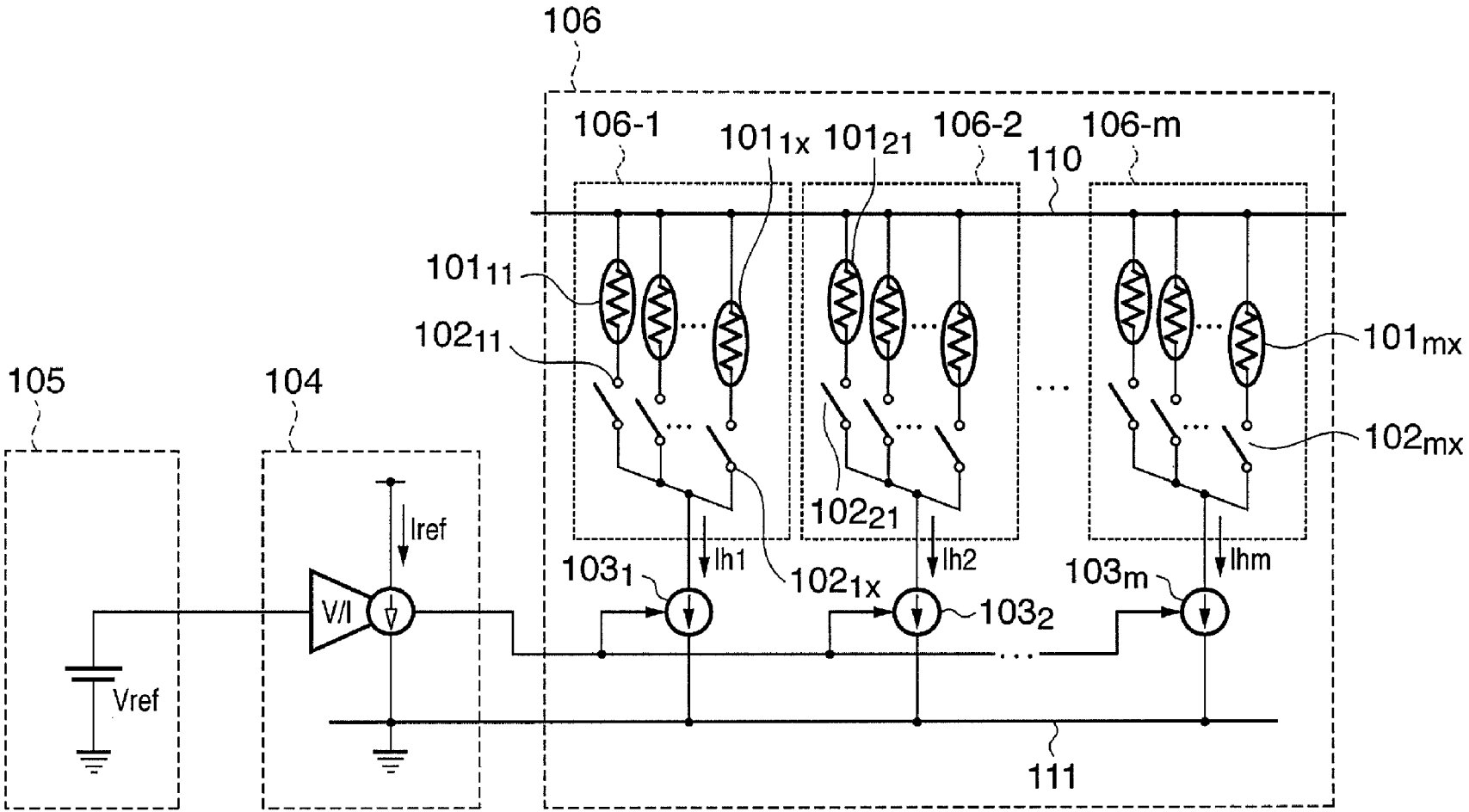
FIG. 18 is a block diagram showing an arrangement example of a heater driving circuit provided in a conventional inkjet printhead.

FIG. 17 is a timing chart showing the signal waveforms of gate control signals VGi applied to the control terminals of switching elements 102, a control signal Vs1 to control a switch $\mathbf{109}_1$, a control signal Vs to control a switch 108, and time variations in the amounts of currents flowing to heaters $\mathbf{101}_{11}$ to $\mathbf{101}_{1x}$.

Referring to FIG. 17, "A" mainly indicates the signal waveforms of the gate control signals VGi applied to the control terminals of the switching elements 102. "B" indicates time variations in the amounts of currents flowing to the heaters $\mathbf{101}_{11}$ to $\mathbf{101}_{1x}$. The same reference symbols in the first and second embodiments denote the same signals and operations in FIG. 17, and a description thereof will be omitted.

As is apparent from comparison between FIGS. 10 and 17, the heater driving control method by the gate control signals VGi and the control method of the reference current IR1 by the control signal Vs1 are the same as in the second embodiment. In the third embodiment, however, supply of the reference current (Iref) is also controlled by the control signal Vs.

As described above, the plurality of reference currents IR1 to IRn are generated on the basis of the reference current (Iref). For this reason, when supply of the reference current (Iref) stops, supply of the reference currents IR1 to IRn also stops. According to the second embodiment, the reference current (Iref) is always supplied. On other hand, according to the third embodiment, supply control of the reference current (Iref) is executed at a timing when driving heaters. In addition, when the reference current (Iref) is supplied for a slightly longer time ($t0(<t1)\leqq t<(t4<)t5$ in "A" of FIG. 17) than the supply time of the reference currents IR1 to IRn (e.g., the reference current IR1 is supplied only during the period of $t1\leqq t<t4$ according to "B" of FIG. 17), the supply time of the reference currents IR1 to IRn can be defined by the timing of the reference current (Iref).

According to this embodiment, supply control of the reference current (Iref) can be executed by the control signal Vs supplied to a switch 108. In addition, supply control of the reference currents IR1 to IRn can be executed by control signals Vs1, Vs2, . . . , Vsn supplied to switches $\mathbf{109}_1$ to $\mathbf{109}_n$. Hence, current consumption by the reference current can further be suppressed.

As many apparently widely different embodiments of the present invention can be made without departing from the spirit and scope thereof, it is to be understood that the invention is not limited to the specific embodiments thereof except as defined in the appended claims.

This application claims the benefit of Japanese Patent Application No. 2005-141829 filed on May 13, 2005, which is hereby incorporated by reference herein in its entirety.

The invention claimed is:

1. A head substrate comprising:

a plurality of printing elements;

a plurality of driving elements which are provided in correspondence with said plurality of printing elements and drive said plurality of printing elements;

a reference voltage generation circuit which generates a reference voltage;

a reference current generation circuit which generates a first reference current on the basis of the reference voltage generated by said reference voltage generation circuit;

a plurality of constant current sources, each of which generates a constant current to drive said plurality of printing elements on the basis of the first reference current generated by said reference current generation circuit;

an input circuit which inputs an image signal related to driving of said plurality of driving elements;

a switch which controls supply of the first reference current; and a detection circuit which detects presence/absence of driving of said plurality of driving elements, based on a result of AND operation of the image signal inputted by said input circuit and a timing signal used for determining an ON/OFF control timing of said switch, wherein said switch is ON/OFF-controlled in accordance with a detection result by said detection circuit.

2. The head substrate according to claim 1, further comprising a conversion circuit which generates a plurality of second reference currents on the basis of the first reference current.

3. The head substrate according to claim 2, wherein said switch is provided in said reference current generation circuit.

4. The head substrate according to claim 2, wherein said switch is provided in said conversion circuit to individually control supply of the plurality of second reference currents generated by said conversion circuit, said switch comprising switches as many as the second reference currents.

5. The head substrate according to claim 1, wherein said plurality of printing elements and said plurality of driving elements are grouped into a plurality of groups, and said plurality of constant current sources are arranged in correspondence with said plurality of groups to respectively supply the constant current to said plurality of groups.

6. The head substrate according to claim 5, wherein, out of said plurality of printing elements included in each of said plurality of groups, no more than one printing element from each of said plurality of groups is concurrently driven.

7. The head substrate according to claim 6, wherein said input circuit comprises a shift register which serially inputs an image signal corresponding to a concurrently drivable unit; and a latch circuit which latches the image signal input to said shift register.

8. The head substrate according to claim 7, wherein said detection circuit determines, on the basis of the image signal input to said latch circuit, whether or not an image signal to drive at least one printing element is present.

9. The head substrate according to claim 7, wherein said detection circuit determines, on the basis of the image signal corresponding to the concurrently drivable unit, whether or not an image signal to drive at least one printing element is present.

10. The head substrate according to claim 7, wherein, if no printing element in the concurrently drivable block is to be driven, said switch is turned off to stop supplying the current.

11. A printhead using a head substrate according to claim 1.

12. The printhead according to claim 11, wherein the printhead comprises an inkjet printhead which prints by discharging ink.

13. A head cartridge integrating an inkjet printhead according to claim 12 and an ink tank containing ink supplied to the inkjet printhead.

14. A printing apparatus for printing on a printing medium by discharging ink from an inkjet printhead according to claim 12.

* * * * *